US009733587B2

(12) United States Patent
Kobayashi

(10) Patent No.: US 9,733,587 B2
(45) Date of Patent: Aug. 15, 2017

(54) LIGHT-EMITTING APPARATUS AND IMAGE FORMATION APPARATUS

(71) Applicant: Oki Data Corporation, Tokyo (JP)

(72) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/131,515

(22) Filed: Apr. 18, 2016

(65) Prior Publication Data

US 2016/0349661 A1 Dec. 1, 2016

(30) Foreign Application Priority Data

May 28, 2015 (JP) ..... 2015-108724

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04054* (2013.01)

(58) Field of Classification Search
CPC ..... G03G 15/043; G03G 15/04054; G03G 15/5058; G03G 15/0131; G03G 15/50
USPC ..... 399/4, 220, 221
See application file for complete search history.

(56) References Cited

U.S. PATENT DOCUMENTS

2010/0135699 A1* 6/2010 Yamaguchi ..... G03G 15/04045 399/220
2010/0182392 A1* 7/2010 Nagumo ..... B41J 2/45 347/237
2012/0229866 A1* 9/2012 Miyazaki ..... H04N 1/407 358/3.13

FOREIGN PATENT DOCUMENTS

JP H10-067140 A 3/1998

* cited by examiner

*Primary Examiner* — Walter L Lindsay, Jr.
*Assistant Examiner* — Jessica L Eley
(74) *Attorney, Agent, or Firm* — Mots Law, PLLC

(57) ABSTRACT

A light-emitting apparatus includes: first and second array-shaped light emitters arranged in substantially parallel with each other to have a overlapping portion where a part of an area where the first array-shaped light emitter is capable of forming an image and a part of an area where the second array-shaped light emitter is capable of forming an image are overlapped with each other; a division unit that divides, based on a pixel pattern of bit map data including multiple pixel data, the bit map data into a first partial bit map data and a second partial bit map data; and a controller that allocates the first and second partial bit map data to the first and second array-shaped light emitters, respectively, and controls the first and second array-shaped light emitters based on the first and second partial bit map data.

11 Claims, 26 Drawing Sheets

LIGHT-EMITTING APPARATUS AND IMAGE FORMATION APPARATUS

CROSS REFERENCE TO RELATED APPLICATIONS

This application claims priority based on 35 USC 119 from prior Japanese Patent Application No. 2015-108724 filed on May 28, 2015, entitled "LIGHT-EMITTING APPARATUS AND IMAGE FORMATION APPARATUS", the entire contents of which are incorporated herein by reference.

BACKGROUND OF THE INVENTION

1. Field of the Invention

The disclosure relates to a light-emitting apparatus and an image formation apparatus.

2. Description of Related Art

In an image formation apparatus using an electrophotographic printing method, a photosensitive drum is negatively charged by a charge roller. Thereafter, a negatively charged portion in the photosensitive drum is irradiated with light beams from an exposure head, thereby forming an electrostatic latent image. The electrostatic latent image is developed by a developer that is supplied from a development roller and a supply roller, and a developer image generated by the development is transferred onto paper by a transfer roller.

In the above-mentioned image formation apparatus, as for a strategy to achieve the printing of an image having a large number of pixels or a large-sized image, for example, it can be considered to use: a wide light-emitting head that has a width equivalent to the width of printing paper, but which is expensive and lacks a general-purpose property; or a light-emitting head module that has a width equivalent to the width of printing paper with multiple narrow light-emitting heads being arranged in parallel. Japanese Patent Application Publication No. H10-67140, for example, discloses a feature related to the light-emitting head module.

SUMMARY OF THE INVENTION

To output a large-sized image or an image having a large number of pixels, continuous images are formed using two or more array-shaped light emitters having multiple light-emitting elements having a range or the number of pixels smaller than that of the image to be outputted. In using the conventional technologies, however, a streak is generated at a connected portion of the images across the respective array-shaped light emitters.

An objective of one embodiment of the invention is to provide a light-emitting apparatus and an image formation apparatus that are capable of making the streak be inconspicuous.

A first aspect of the invention is a light-emitting apparatus that includes: first and second array-shaped light emitters arranged in substantially parallel with each other to have a overlapping portion where a part of an area where the first array-shaped light emitter is capable of forming an image and a part of an area where the second array-shaped light emitter is capable of forming an image are overlapped with each other; a division unit that divides, based on a pixel pattern of bit map data including multiple pixel data, the bit map data into a first partial bit map data and a second partial bit map data; and a controller that allocates the first and second partial bit map data to the first and second array-shaped light emitters, respectively, and controls the first and second array-shaped light emitters based on the first and second partial bit map data.

A second aspect of the invention is an image formation apparatus that includes: an image carrier that includes a peripheral surface with a photoreceptor layer; the light emitting apparatus according to the first aspect as an exposure unit that is placed facing the peripheral surface and exposes the peripheral surface to form a latent image; a development member that is placed facing the peripheral surface, and develops the latent image with a developer.

According to the aspects of the invention, the streaks can be made to be inconspicuous in a displayed image or a printed image, for example.

DETAILED DESCRIPTION OF EMBODIMENTS

Figure 1:
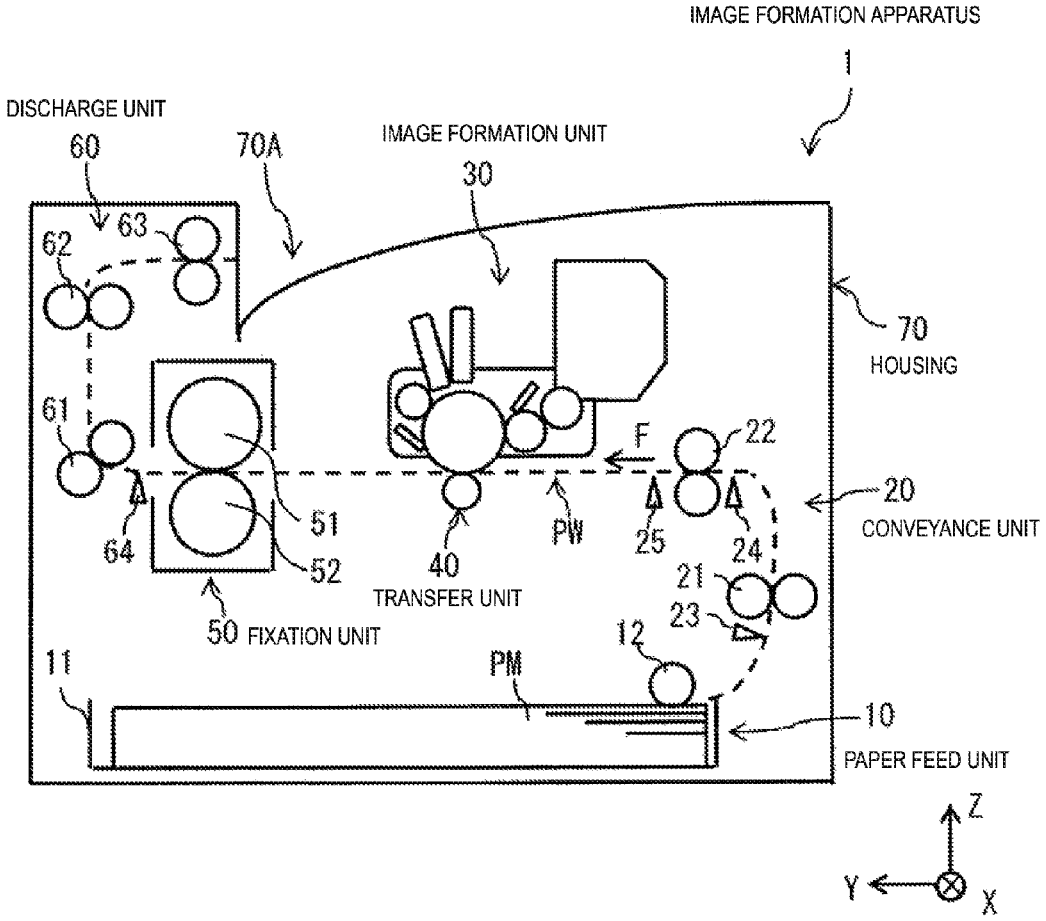
FIG. 1 is a diagram illustrating a schematic configuration example of an image formation apparatus according to a first embodiment of the invention.

Hereinafter, embodiments of the invention are described in detail with reference to the drawings. The following description is merely one concrete example of the invention, and the invention is not limited to the aspects described below.

Moreover, placements, sizes and ratios of the sizes of respective components illustrated in the drawings are not limited to those in the invention. The description is made in the following order.

1. First Embodiment

An example in which a module including two LED heads is provided.

2. Second Embodiment

An example in which the above-mentioned module is provided in each image formation unit.

3. Third Embodiment

An example in which the above-mentioned module is used in a display apparatus that uses an after-image effect.

4. Fourth Embodiment

An example in which the multiple above-mentioned modules are used in a display apparatus that uses the after-image effect.

5. Modification Examples

<1. First Embodiment>

[Configuration]

FIG. 1 illustrates a schematic configuration example of image formation apparatus 1 according to a first embodiment of the invention. Image formation apparatus 1 is a printer that forms an image on medium PM, such as paper, using an electrophotographic printing method. Image formation apparatus 1 is provided with paper feed unit 10, conveyance unit 20, image formation unit 30, transfer unit 40, fixation unit 50, and discharge unit 60. Paper feed unit 10, conveyance unit 20, image formation unit 30, transfer unit 40, fixation unit 50, and discharge unit 60 are provided in the inside of housing 70.

In the description, a path through which medium PM is conveyed is called conveyance path PW. In conveyance path PW, a direction toward paper feed unit 10 or a position closer to paper feed unit 10 as seen from an arbitrary component is called "upstream of conveyance path PW". In conveyance path PW, an opposite direction to the direction toward paper feed unit 10 or a position farther apart from paper feed unit 10 as seen from an arbitrary component is called "downstream of conveyance path PW". In conveyance path PW, a direction toward which medium PM travels (in other words, a direction from the upstream of conveyance path PW toward the downstream of conveyance path PW) is called conveyance direction F.

(Configuration of Paper Feed Unit 10)

Paper feed unit 10 is configured to supply media PM one by one to conveyance path PW. Paper feed unit 10 includes, for example, paper feed tray 11 and pickup roller 12. Paper feed tray 11 contains therein multiple media PM being stacked one on another. Paper feed tray 11 is mounted to, for example, a lower portion of image formation apparatus 1 in a detachable manner. Pickup roller 12 supplies medium PM that is contained in paper feed tray 11 to conveyance unit 20. Pickup roller 12 performs a rotation operation in a direction to allow medium PM to be fed out onto conveyance path PW under the control of control board 100, which is described later.

(Configuration of Conveyance Unit 20)

Conveyance unit 20 is configured to covey medium PM from paper feed unit 10 to transfer unit 40 along conveyance path PW while restricting any tilting of medium PM. Conveyance unit 20 is placed at the downstream of conveyance path PW from paper feed unit 10. Conveyance unit 20 includes, for example, pairs of registration rollers 21 and 22, and sensors 23, 24, and 25.

The pair of registration rollers 21 is placed at the upstream of conveyance path PW from the pair of registration rollers 22. The pair of registration rollers 21 performs an abutting process with respect to medium PM that is conveyed through conveyance path PW, and thereafter conveys medium PM in conveyance direction F along conveyance path PW. The abutting process indicates a process to cause a tip of medium PM conveyed from paper feed unit 10 to abut against pair of registration rollers 21, the rotation of which is stopped. When medium PM is conveyed, pair of registration rollers 21 performs a rotation operation in a direction to allow medium PM to be conveyed in conveyance direction F under the control of control board 100. Sensor 23 is placed at the upstream of conveyance path PW from pair of registration rollers 21. Sensor 23 detects a position of medium PM so as to adjust a drive timing of pair of registration rollers 21. Sensor 23 detects, for example, medium PM that is conveyed through conveyance path PW.

Pair of registration rollers 22 is placed at the downstream of conveyance path PW from pair of registration rollers 21. Pair of registration rollers 22 conveys medium PM that is conveyed through conveyance path PW in conveyance direction F along conveyance path PW. Pair of registration rollers 22 performs a rotation operation to allow medium PM to be conveyed in conveyance direction F under the control of control board 100. Sensor 24 is placed on conveyance path PW at the upstream side from pair of registration rollers 22. Sensor 24 detects a position of medium PM so as to adjust a drive timing of pair of registration rollers 22. Sensor 24 detects, for example, medium PM that is conveyed through conveyance path PW. Sensor 25 is placed on conveyance path PW at the downstream side from pair of registration rollers 22. Sensor 25 detects a position of medium PM so as to adjust a timing for image formation in image formation unit 30. Sensor 25 detects, for example, medium PM that is conveyed through conveyance path PW.

(Configuration of Image Formation Unit 30)

Figure 2A:
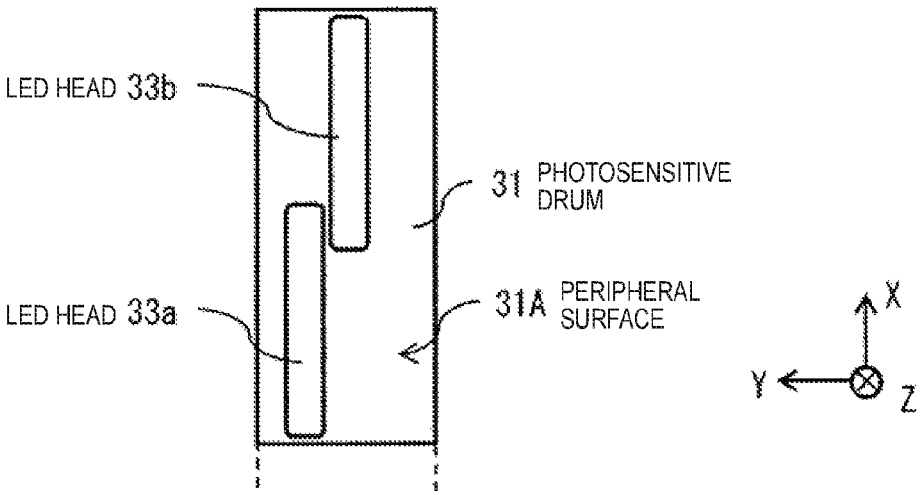
FIGS. 2A and 2B are diagrams illustrating a schematic configuration example of an image formation unit in FIG. 1.
Figure 2B:
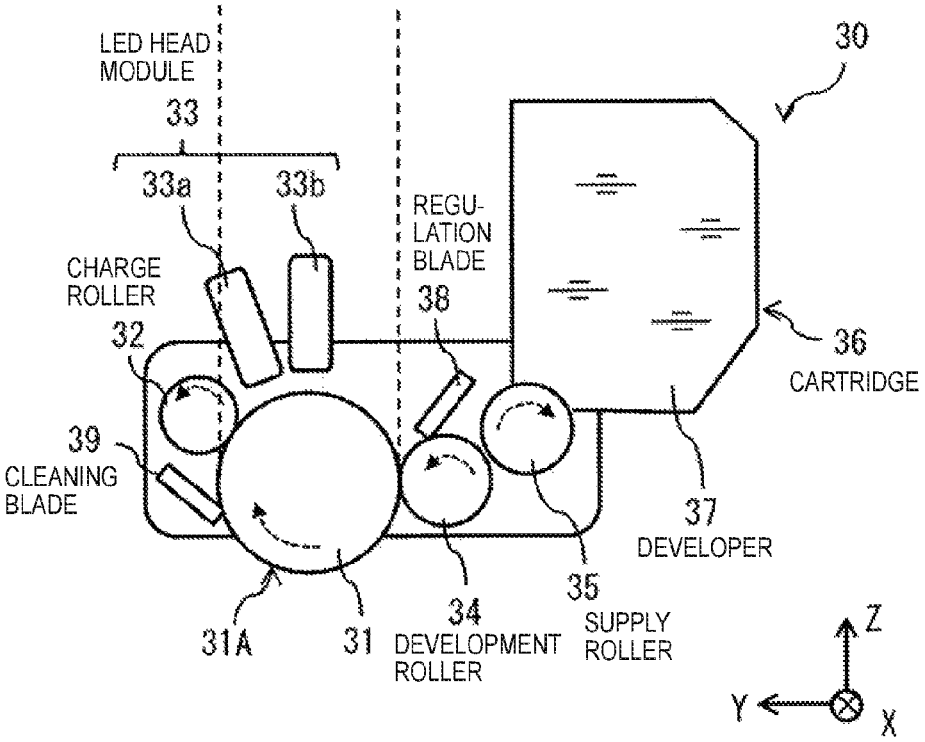

FIGS. 2A and 2B illustrate a schematic configuration example of image formation unit 30. Image formation unit 30 is placed at the downstream of conveyance path PW from conveyance unit 20. Image formation unit 30 is configured to form an image onto peripheral surface 31A of photosensitive drum 31, which is described later. Image formation unit 30 includes photosensitive drum 31, charge roller 32, light emitting diode (LED) head module 33, development roller 34, supply roller 35, cartridge 36, regulation blade 38, and cleaning blade 39, for example, as illustrated in FIG. 2B. Cartridge 36 is filled with developer 37. Photosensitive drum 31 corresponds to a specific example of an "image carrier" of the invention. Peripheral surface 31A corresponds to a specific example of a "peripheral surface" of the invention. LED head module 33 corresponds to a specific example of an "exposure unit" of the invention. Development roller 34 corresponds to a specific example of a "development member" of the invention. Developer 37 corresponds to a specific example of a "developer" of the invention.

Photosensitive drum 31 includes peripheral surface 31A with a photoreceptor (for example, an organic photoreceptor), and is a cylindrical member that can support an electrostatic latent image on peripheral surface 31A. Specifically, photosensitive drum 31 includes a conductive support, and a photoconductive layer that covers an outer circumference (surface) thereof. The conductive support is configured to include, for example, a metal pipe made of aluminum. The photoconductive layer includes a structure, for example, in which a charge generation layer and a charge transport layer are sequentially stacked. A surface of the photoconductive layer forms peripheral surface 31A. Photosensitive drum 31 performs a rotation operation to allow medium PM to be conveyed in conveyance direction F at a predetermined circumferential speed, under the control of control board 100.

Charge roller 32 is a member (charge member) that charges peripheral surface 31A of photosensitive drum 31. Charge roller 32 is placed facing peripheral surface 31A, and so as to come into contact with peripheral surface 31A of photosensitive drum 31. Charge roller 32 includes, for example, a metal shaft made of stainless steel, and a semiconducting elastic layer (for example, semiconducting epichlorohydrin rubber layer) that covers an outer circumference (surface) thereof. Charge roller 32 performs a rotation operation in the direction opposite to the direction of rotation of photosensitive drum 31 by the transmission of a drive from photosensitive drum 31, for example.

LED head module 33 is an exposure device that exposes a charged region of peripheral surface 31A that is charged by charge roller 32 to form an electrostatic latent image in the charged region of peripheral surface 31A. LED head module 33 is placed facing peripheral surface 31A. LED head module 33 includes two LED heads 33*a* and 33*b*. Two LED heads 33*a* and 33*b* each have a band-like shape that extends in a width direction of photosensitive drum 31, as illustrated in FIG. 2A, for example. Two LED heads 33*a* and 33*b* are placed in parallel such that end portions of two LED heads 33*a* and 33*b* are overlapped with each other in a travel direction of peripheral surface 31A. Two LED heads 33*a* and 33*b* are arranged in parallel with each other, and arranged such that a part of an area where LED head 33*a* is capable of forming an image and a part of an area where LED head 33*b* is capable of forming an image are overlapped with each other. Accordingly, mounted positions of two LED heads 33*a* and 33*b* are offset from each other in a rotation direction of peripheral surface 31A. FIG. 2A and FIG. 2B exemplify a case where LED head 33*a* is placed at an upstream side of LED head 33*b* in the rotation direction of peripheral surface 31A. Note that, a description of an operation and the like of image formation apparatus 1 is hereinafter made assuming that LED head 33*a* is placed at the upstream side of LED head 33*b* in the rotation direction of peripheral surface 31A.

LED head 33*a* includes line light emitter 133*a*. Line light emitter 133*a* is one of the array-shaped heads in which multiple light emitters are placed in an array, and is configured to include multiple LEDs 137 that are placed in a row, for example. LED head 33*b* includes line light emitter 133*b*. Line light emitter 133*b* is one of the array-shaped heads in which multiple light emitters are placed in an array, and is configured to include multiple LEDs 137 that are placed in a row, for example. Two line light emitters 133*a* and 133*b* each have a band-like shape that extends in the width direction of photosensitive drum 31, as illustrated in FIG. 2A, for example. Two line light emitters 133*a* and 133*b* are placed in parallel such that the end portions of two line light emitters 133*a* and 133*b* are overlapped with each other in the travel direction of peripheral surface 31A. Each of LED heads 33*a* and 33*b* may include a lens array that causes irradiation light emitted from each of line light emitters 133*a* and 133*b* to form an image on a surface of photosensitive drum 31, for example.

Development roller 34 is a member that supports charged developer 37 on a surface thereof, and develops an electrostatic latent image with developer 37. Development roller 34 is placed facing peripheral surface 31A, and so as to come into contact with peripheral surface 31A of photosensitive drum 31. Development roller 34 includes, for example, a metal shaft made of stainless steel, and a semiconducting elastic layer (for example, a semiconducting urethane rubber layer) that covers an outer circumference (surface) thereof. Development roller 34 performs a rotation operation in the direction opposite to the direction of rotation of photosensitive drum 31 at a predetermined circumferential speed by the transmission of a drive from photosensitive drum 31, for example.

Supply roller 35 is a member (supply member) that supplies developer 37 to development roller 34, and is placed so as to come into contact with a surface (peripheral surface) of development roller 34. Supply roller 35 includes, for example, a metal shaft, and a foaming elastic layer (for example, a silicone rubber layer) that covers an outer circumference (surface) thereof. Supply roller 35 performs a rotation operation in the direction opposite to the direction of rotation of development roller 34, by the transmission of a drive from development roller 34, for example.

Cartridge 36 is a container in which developer 37 is contained. Regulation blade 38 regulates the layer thickness of developer 37 that is supported on the surface of development roller 34. Developer 37 is, for example, a non-magnetic, one-component developer. Regulation blade 38 is made of, for example, a steel use stainless (SUS) sheet. Cleaning blade 39 scrapes off developer 37 remaining on the surface of photosensitive drum 31. Cleaning blade 39 is made of, for example, a flexible rubber material or a plastic material.

(Configuration of Transfer Unit 40)

Transfer unit 40 is configured to electrostatically transfer an image (developer image) that is formed on peripheral surface 31A of photosensitive drum 31 onto medium PM that is conveyed from conveyance unit 20. Transfer unit 40 is configured to include, for example, a transfer roller. The transfer roller is placed facing photosensitive drum 31. The transfer roller is made of, for example, a foaming semiconducting elastic rubber material.

(Configuration of Fixation Unit 50)

Fixation unit 50 is a member that applies heat and pressure to a developer image that is formed on medium PM having passed through transfer unit 40 to fix the developer image onto medium PM. Fixation unit 50 is placed at the downstream of conveyance path PW from transfer unit 40. Fixation unit 50 is configured to include, for example, upper roller 51 and lower roller 52.

Upper roller 51 and lower roller 52 are configured to each include a heat source that is a heater such as a halogen lamp in the inside thereof, and function as heat rollers that apply heat to the developer image on medium PM. Upper roller 51 performs a rotation operation to allow medium PM to be conveyed in conveyance direction F, under the control of control board 100. The heat sources in upper roller 51 and lower roller 52 respectively control the surface temperatures of upper roller 51 and lower roller 52 by a supply of bias voltages controlled by control board 100. Lower roller 52 is placed facing upper roller 51 so as to allow a pressure contact portion to be formed with upper roller 51, and functions as a pressurization roller that applies the pressure to the developer image on medium PM. Lower roller 52 may include a surface layer made of an elastic material.

(Configuration of Discharge Unit 60)

Discharge unit 60 is configured to discharge medium PM on which a developer image is fixed by fixation unit 50 to the outside. Discharge unit 60 includes, for example, pairs of conveyance rollers 61, 62, and 63, and sensor 64. Pairs of conveyance rollers 61, 62, and 63 discharge medium PM to the outside through conveyance path PW, and cause discharged medium PM to be stacked in external stacker 70A. Pairs of conveyance rollers 61, 62, and 63 perform rotation operations to allow medium PM to be conveyed in conveyance direction F, under the control of control board 100. Further, pairs of conveyance rollers 61, 62, and 63 discharge medium PM facedown to the outside, for example.

Sensor 64 is placed at the upstream from pairs of conveyance rollers 61, 62, and 63. Sensor 64 detects a position of medium PM so as to adjust the drive timings of pairs of conveyance rollers 61, 62, and 63. Sensor 64 detects, for example, medium PM that is conveyed through conveyance path PW.

(Control Mechanism)

Figure 3:
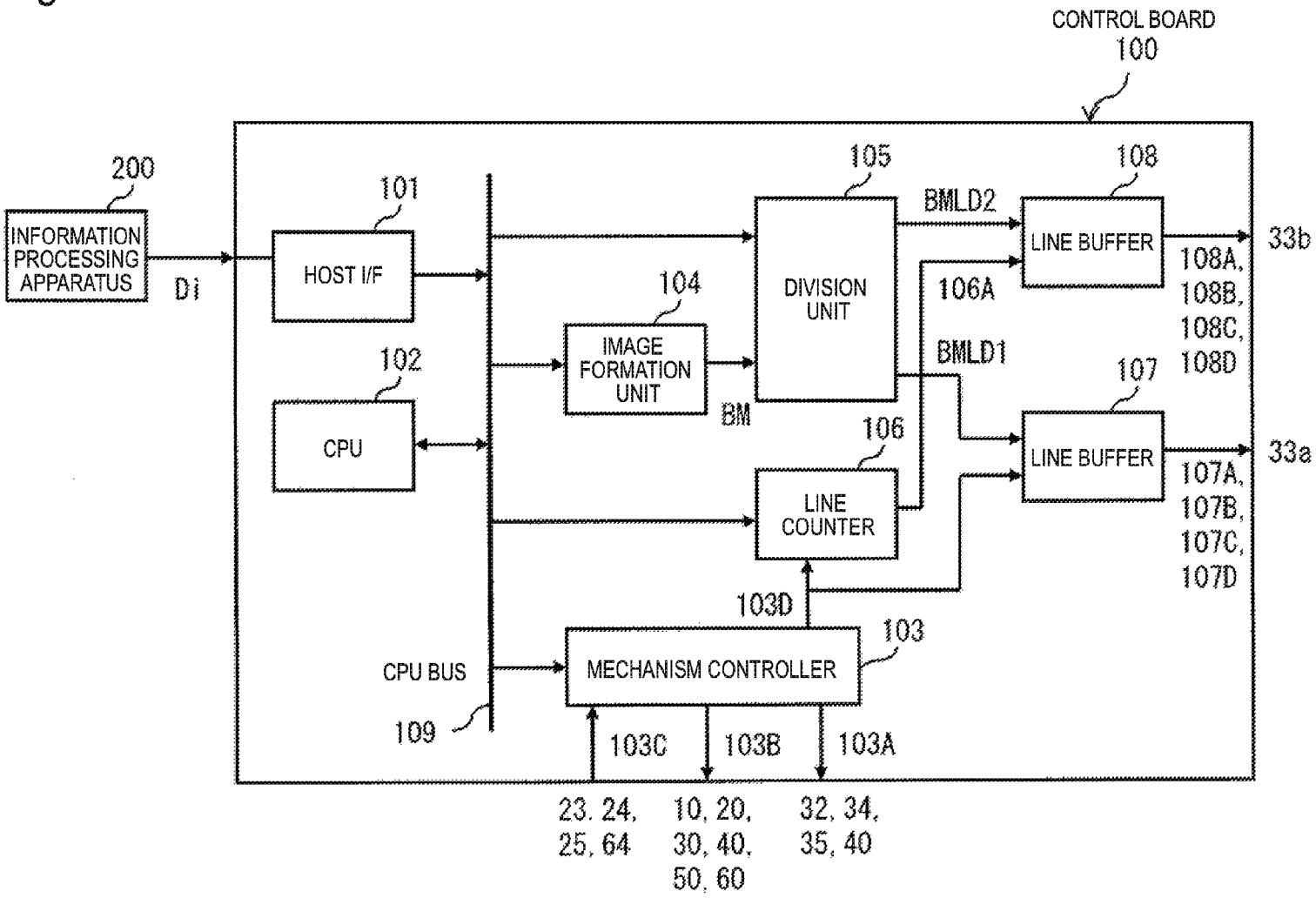
FIG. 3 is a diagram illustrating a function block example of a control board in the image formation apparatus in FIG. 1.

Next, a part of a control mechanism of image formation apparatus 1 is described with reference to FIG. 3 in addition to FIG. 1. FIG. 3 is a diagram illustrating a function block example of control board 100 in image formation apparatus 1. As illustrated in FIG. 1 and FIG. 3, image formation apparatus 1 is provided with control board 100 as a control mechanism. Control board 100 includes, for example, host I/F 101, CPU 102, mechanism controller 103, image formation unit 104, division unit 105, line counter 106, and line buffers 107 and 108. Host I/F 101, CPU 102, mechanism controller 103, image formation unit 104, division unit 105, and line counter 106 are connected to CPU bus 109, for example.

Host I/F 101 captures image data Di transmitted from external information processing apparatus 200 that is connected to image formation apparatus 1, and transfers image data Di to CPU 102. CPU 102 performs an overall control by sending out data and control signals to mechanism controller 103, image formation unit 104, division unit 105, and line counter 106, for example. Mechanism controller 103 outputs control signals 103B to motors that drive charge roller 32 and other rollers based on detection signals 103C from sensor 23 and other sensors and a control signal from CPU 102, for example. Mechanism controller 103 further outputs high voltages 103A, that are applied to charge roller 32 and other rollers, to image formation unit 30 and other units based on detection signals 103C from sensor 23 and other sensors and a control signal from CPU 102, for example. Moreover, mechanism controller 103 generates line synchronization signal 103D based on a control signal from CPU 102, for example, and outputs line synchronization signals 103D to line counter 106 and line buffer 107. The control signal from CPU 102 includes a setting value (such as timing ta0, which is described later) related to a timing of outputting head data 107B. Line synchronization signal 103D is a signal to control a timing of outputting head data 107B from line buffer 107.

Image formation unit 104 captures image data Di transmitted from external information processing apparatus 200 that is connected to image formation apparatus 1, and converts image data Di into data with a printable data format. Examples of the printable data format include image data such as bit map data BM. Note that, a description is hereinafter made assuming that image formation unit 104 converts image data Di into bit map data BM. Image formation unit 104 outputs generated bit map data BM to division unit 105. Division unit 105 divides, based on a pixel pattern of bit map data BM, bit map data BM into two line data BMLD1 and BMLD2. Bit map data BM corresponds to a specific example of "bit map data" of the invention. Two line data BMLD1 and BMLD2 correspond to a specific example of "first and second partial bit map data" of the invention. Division unit 105 outputs generated line data BMLD1 to line buffer 107. Division unit 105 outputs generated line data BMLD2 to line buffer 108. Note that, a division method of bit map data BM is described later in detail.

Line counter 106 outputs line synchronization signal 106A to line buffer 108 at a timing delayed by a predetermined time from a timing when line synchronization signal 103D from mechanism controller 103 is inputted thereto, based on a control signal from CPU 102. In this process, the control signal from CPU 102 includes a setting value (such as timing tb0, tb1, tb2, tb3, or tb4, which is described later) related to a timing of outputting head data 108B.

As described above, mounted positions of two LED heads 33*a* and 33*b* are offset from each other in the rotation direction of peripheral surface 31A. This results in different printing start positions of two LED heads 33*a* and 33*b*, so that a printing start timing of LED head 33*b* needs to be delayed by a time corresponding to a difference between the printing start positions from a printing start timing of LED head 33*a*. Line counter 106 outputs line synchronization signal 106A to line buffer 108 at a timing delayed from a timing when line synchronization signal 103D is inputted into line buffer 107. This allows the printing start timing of LED head 33*b* to be delayed from the printing start timing of LED head 33*a*.

Line buffer 107 outputs line data BMLD1, inputted from division unit 105, as head data 107B to LED head 33*a* at a predetermined timing (specifically, at a timing when line synchronization signal 103D is inputted thereto). Line buffer 108 outputs line data BMLD2, inputted from division unit 105, as head data 108B to LED head 33*b* at a predetermined timing (specifically, at a timing when line synchronization signal 106A is inputted thereto). Line buffers 107 and 108 output, in addition to head data 107B and 108B, clocks 107A and 108A, latch signals 107C and 108C, and strobe signals 107D and 108D, to LED heads 33*a* and 33*b*.

Figure 4:
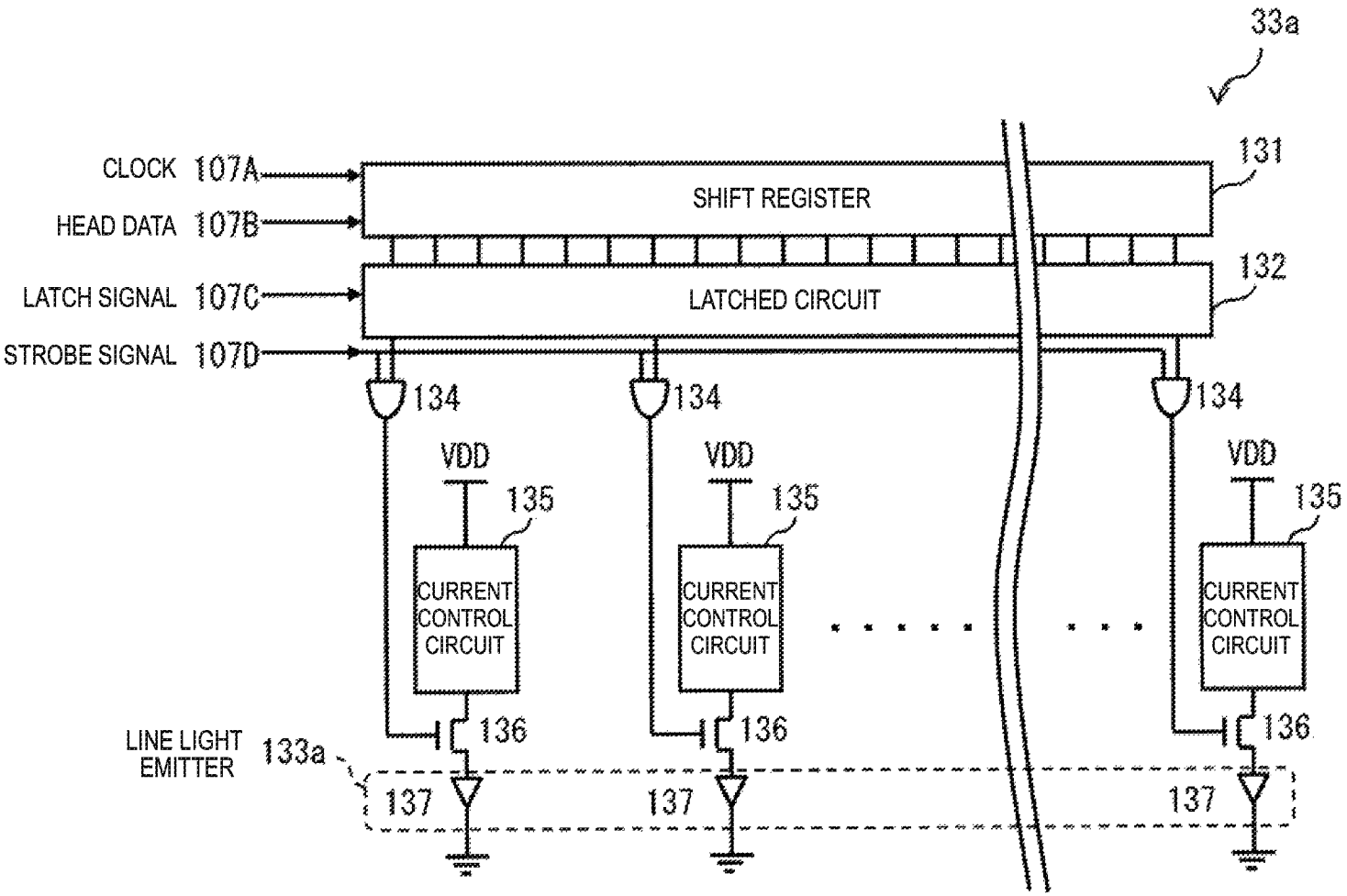
FIG. 4 is a diagram illustrating a circuit configuration example of an LED head in FIG. 2.
Figure 5:
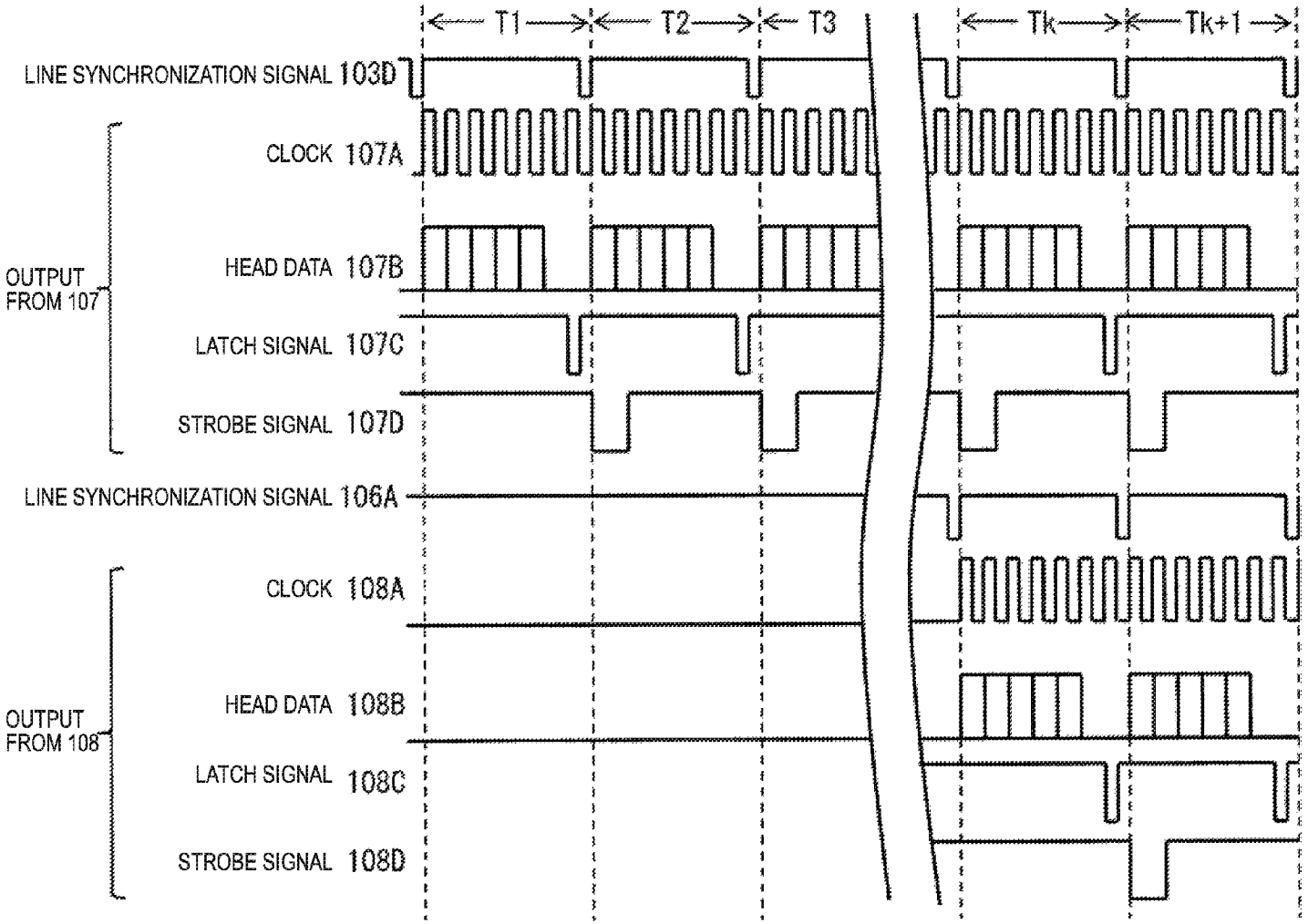
FIG. 5 is a diagram illustrating an example of various kinds of waveforms in the control board in FIG. 3.

Next, LED heads 33*a* and 33*b* are described. LED heads 33*a* and 33*b* have the same configuration. Therefore, LED head 33*a* as a representative of LED heads 33*a* and 33*b* is hereinafter described. FIG. 4 illustrates a circuit configuration example of LED head 33*a*. FIG. 5 illustrates examples of various kinds of waveforms in control board 100.

LED head 33*a* includes, for example, shift register 131, latched circuit 132, line light emitter 133*a*, multiple AND gates 134, multiple current control circuits 135, and multiple FETs 136. One of multiple AND gates 134, one of multiple current control circuits 135, and one of multiple FETs 136 are allocated to each LED 137. For example, each current control circuit 135 and each FET 136 are connected in series between an anode-side terminal of each LED 137 and constant voltage VDD. An output terminal of each AND gate 134 is connected to a gate of each FET 136, and to wiring to which strobe signal 107D is inputted; and one of the output terminals of latched circuit 132 is respectively connected to two input terminals of each AND gate 134.

Shift register 131 outputs serial head data 107B that is inputted from control board 100, as parallel head data 107B, to latched circuit 132. In LED head 33*a*, shift register 131 receives serial head data 107B one by one that is started to be inputted in synchronization with an input of line synchronization signal 103D, in accordance with an input of clock 107A, for example. In LED head 33*b*, shift register 131 receives serial head data 108B one by one that is started to be inputted in synchronization with an input of line synchronization signal 106A, in accordance with an input of clock 108A, for example. Note that, FIG. 5 exemplifies a state where an input of serial head data 107B is started from period T1, and an input of serial head data 108B is started from period Tk.

In LED head 33*a*, latched circuit 132 simultaneously captures parallel head data 107B inputted from shift register 131 at a timing when latch signal 107C is inputted, and outputs captured head data 107B. In LED head 33*b*, latched circuit 132 simultaneously captures parallel head data 108B inputted from shift register 131 at a timing when latch signal 108C is inputted, and outputs captured head data 108B.

In LED head 33*a*, AND gate 134 outputs an on-state voltage that makes a gate of FET 136 turn on to the gate of FET 136, when both of strobe signal 107D and latch signal 107C are inputted. In LED head 33*b*, AND gate 134 outputs an on-state voltage that makes a gate of FET 136 turn on to the gate of FET 136, when both of strobe signal 108D and latch signal 108C are inputted.

Current control circuit 135 outputs a current necessary for making LED 137 emit light. FET 136 turns on when strobe signals 107D, 108D are inputted. LED 137 emits light with an application of a current larger than a threshold current.

Next, a division method of bit map data BM is described. Firstly, a general division method of bit map data BM is described, and thereafter, a division method of bit map data BM in this embodiment is described.

Figure 6:
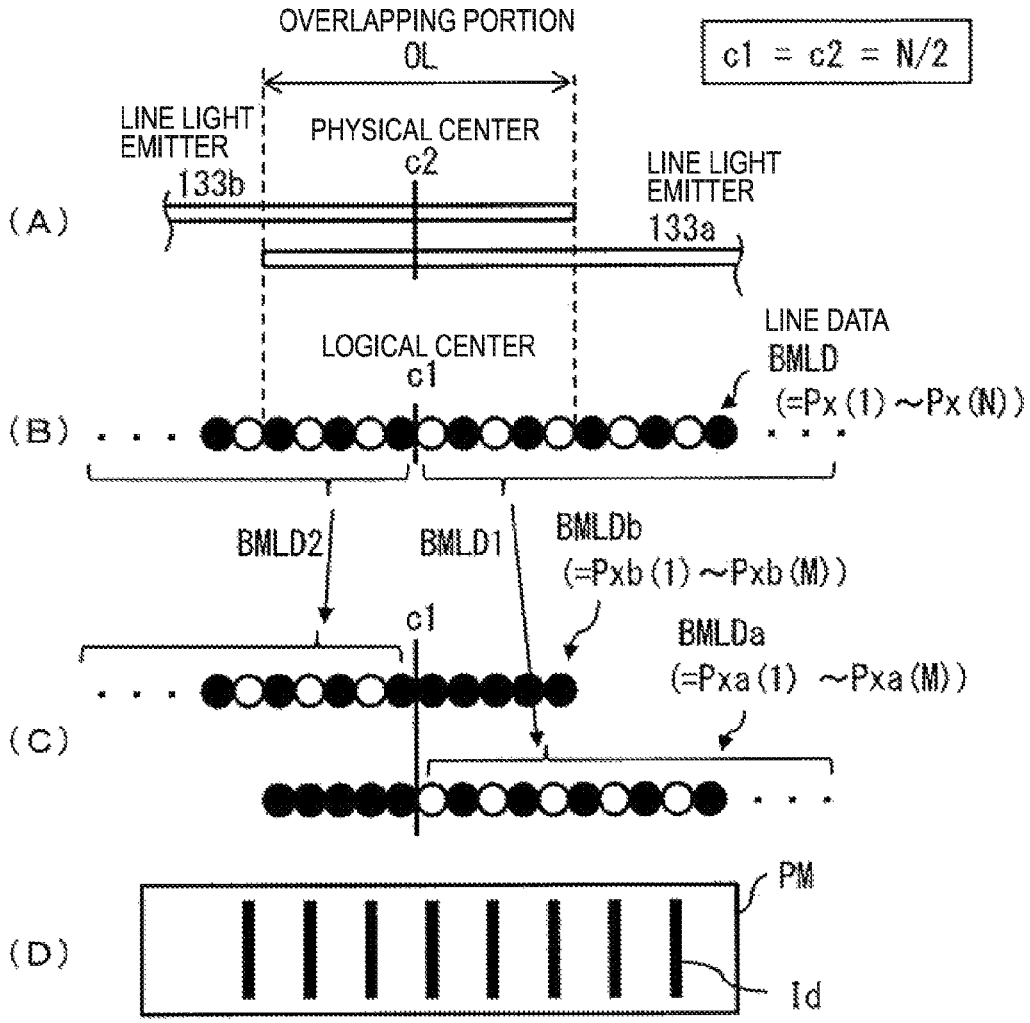
FIG. 6 shows diagrams (A) to (D) illustrating an example of a method in which line data is allocated to two LED heads.

FIG. 6(A) to FIG. 6(D) illustrate an example of a method of allocating line data BMLD1 and line data BMLD2 to two LED heads 33*a* and 33*b* (two line light emitters 133*a* and 133*b*). FIG. 6(A) schematically illustrates two line light emitters 133*a* and 133*b* that are arranged in parallel such that end portions thereof are overlapped with each other in the travel direction of peripheral surface 31A. FIG. 6(B) schematically illustrates data for one line (line data BMLD) that is extracted from bit map data BM. FIG. 6(A) and FIG. 6(B) each exemplify a state where when two line light emitters 133*a* and 133*b* having overlapping portion OL are regarded as one light emitter, a center (physical center c2) of the one light emitter and a center (logical center c1) of line data BMLD correspond to each other. FIG. 6(C) schematically illustrates line data BMLDa allocated to line light emitter 133*a* and line data BMLDb allocated to line light emitter 133*b*. FIG. 6(D) schematically illustrates medium PM on which multiple linear images Id are printed. The overlapping portion OL indicates a portion where image formation allowable areas in two LED heads 33*a* and 33*b* are overlapped with each other.

Line data BMLD includes N pieces of pixel data Px(1) to Px(N). Accordingly, in FIG. 6(A) to FIG. 6(D), logical center c1 is present at a position of pixel data Px(N/2). Line data BMLD is divided into two line data BMLD1 and BMLD2 at logical center c1. Line data BMLD1 is allocated to line light emitter 133*a*, and line data BMLD2 is allocated to line light emitter 133*b*. Each of line light emitters 133*a* and 133*b* includes M pieces of LEDs 137 that are arranged in a row. A value of M is larger than a value of N/2. Accordingly, line data BMLD1 is allocated to a part of line data BMLDa that is allocated to line light emitter 133*a*. In line data BMLDa, an initial value (non-light-emitting data) is allocated to a point where no line data BMLD1 is allocated. Similarly, line data BMLD2 is allocated to apart of line data BMLDb that is allocated to line light emitter 133*b*. In line data BMLDb, an initial value (non-light-emitting data) is allocated to a point where no line data BMLD2 is allocated.

As described above, logical center c1 and physical center c2 correspond to each other. Accordingly, by setting a test chart in which light-emitting (white circle) pixel data and non-light-emitting (black circle) pixel data are alternately aligned, as N pieces of pixel data Px(1) to Px(N) as illustrated in FIG. 6(B), and respectively allocating line data BMLD1 and line data BMLD2 to line data BMLDa and line data BMLDb as described above, the respective linear images Id are printed with a uniform interval as illustrated in FIG. 6(D) when multiple linear images Id are printed on medium PM by two LED heads 33*a* and 33*b*. Further, in a photoreceptor of peripheral surface 31A that is exposed due to the light-emitting of LED 137, a charge potential is lowered and charged developer 37 is adhered thereon, so that pixels are rendered. Accordingly, the light-emitting (white circle) pixel data indicates that a pixel is rendered. In contrast, in the photoreceptor of peripheral surface 31A that is not exposed due to the non-light-emitting of LED 137, a charge potential is held and charged developer 37 is repelled, so that no pixel is rendered. Accordingly, the non-light-emitting (black circle) pixel data indicates that no pixel is rendered.

Figure 7A:
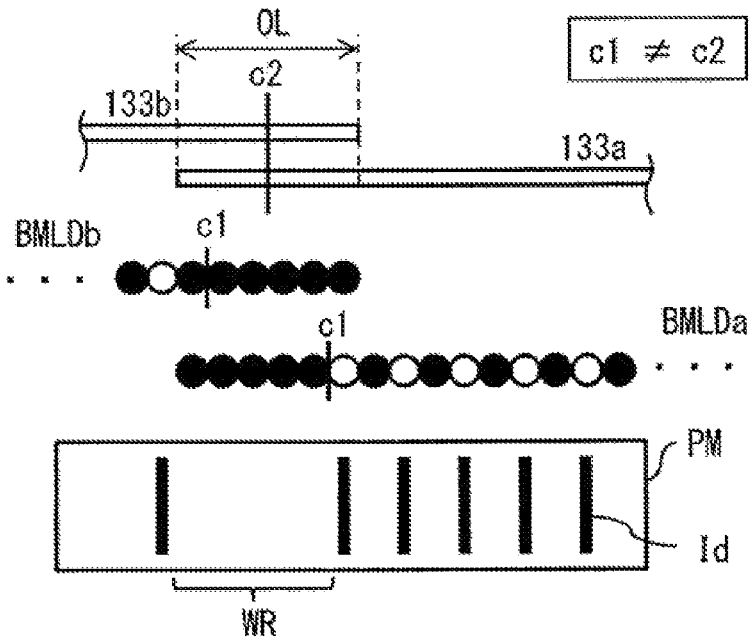
FIG. 7A is a diagram illustrating an example of a white streak that is generated on a printed image when two LED heads are less overlapped with each other than expected.
Figure 7B:
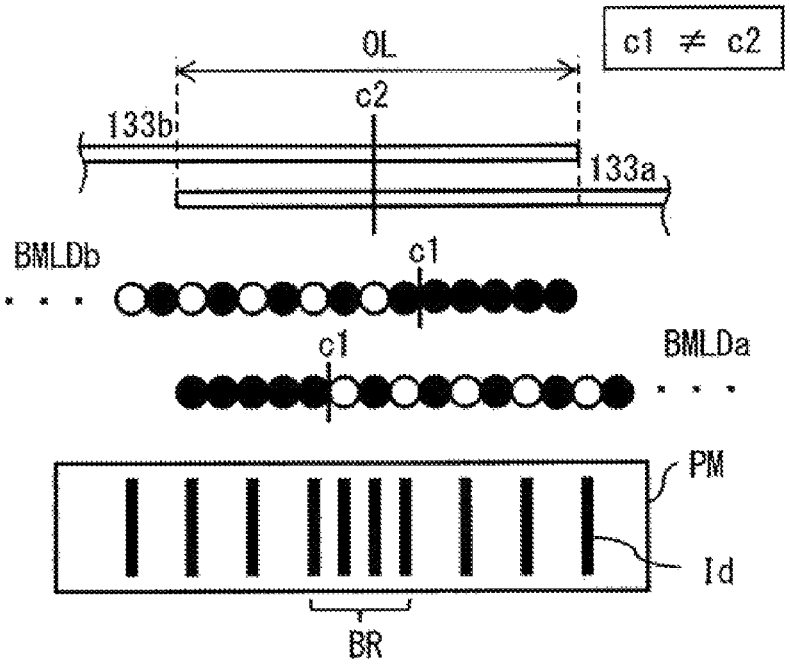
FIG. 7B is a diagram illustrating an example of a black streak that is generated on a printed image when two LED heads are more overlapped with each other than expected.

However, a placement error between two LED heads 33*a* and 33*b* causes a difference in size between actual overlapping portion OL and overlapping portion OL when logical center c1 and physical center c2 correspond to each other, as illustrated in FIG. 7A and FIG. 7B, for example. This causes white region WR or black region BR to appear in printed monochrome stripes when line data BMLD is divided into two line data BMLD1 and BMLD2 at logical center c1. An observer recognizes white region WR and black region BR as streaks. The attachment of two LED heads 33*a* and 33*b* with high accuracy allows such streaks to be inconspicuous. However, an increase in the attachment accuracy of two LED heads 33*a* and 33*b* might result in a significantly raised manufacturing cost.

Next, a division method of bit map data BM in this embodiment is described. The division of bit map data BM in this embodiment is executed through procedures as follows:

(1) A procedure of identifying overlapping portion OL by using a test chart;

(2) A procedure of adjusting an exposure start timing by using the test chart; and (3) A procedure of dividing line data BMLD based on a pixel pattern.

(Procedure (1))

FIG. 8(A) to FIG. 8(E) conceptually illustrate an example of the procedure of identifying overlapping portion OL by using a test chart. FIG. 9(A) to FIG. 9(C) conceptually illustrate an example of a procedure subsequent to that in FIG. 8. In an upper right part of FIG. 8(A), two line light emitters 133*a* and 133*b* arranged in parallel such that end portions thereof are overlapped with each other in the travel direction of peripheral surface 31A are schematically illustrated. At right sides of FIG. 8(A) to FIG. 8(E) and FIG. 9(A) to FIG. 9(C), line data BMLDa allocated to line light emitter 133*a* and line data BMLDb allocated to line light emitter 133*b* are schematically illustrated. At left sides of FIG. 8(A) to FIG. 8(E) and FIG. 9(A) to FIG. 9(C), media PM on which multiple linear images Id are printed is schematically illustrated.

In FIG. 8(A), setting a0 indicates that line data BMLD1 is set as a test chart in which N/2 pieces of light-emitting (white circle) pixel data and non-light-emitting (black circle) pixel data are alternately aligned. In other words, setting a0 indicates that line data BMLD is divided into two at logical center c1. In FIG. 8(A), setting b0 indicates that line data BMLD2 is set as a test chart in which N/2 pieces of light-emitting (white circle) pixel data and non-light-emitting (black circle) pixel data are alternately aligned. In other words, setting b0 indicates that line data BMLD is divided into two at logical center c1.

Figure 8:
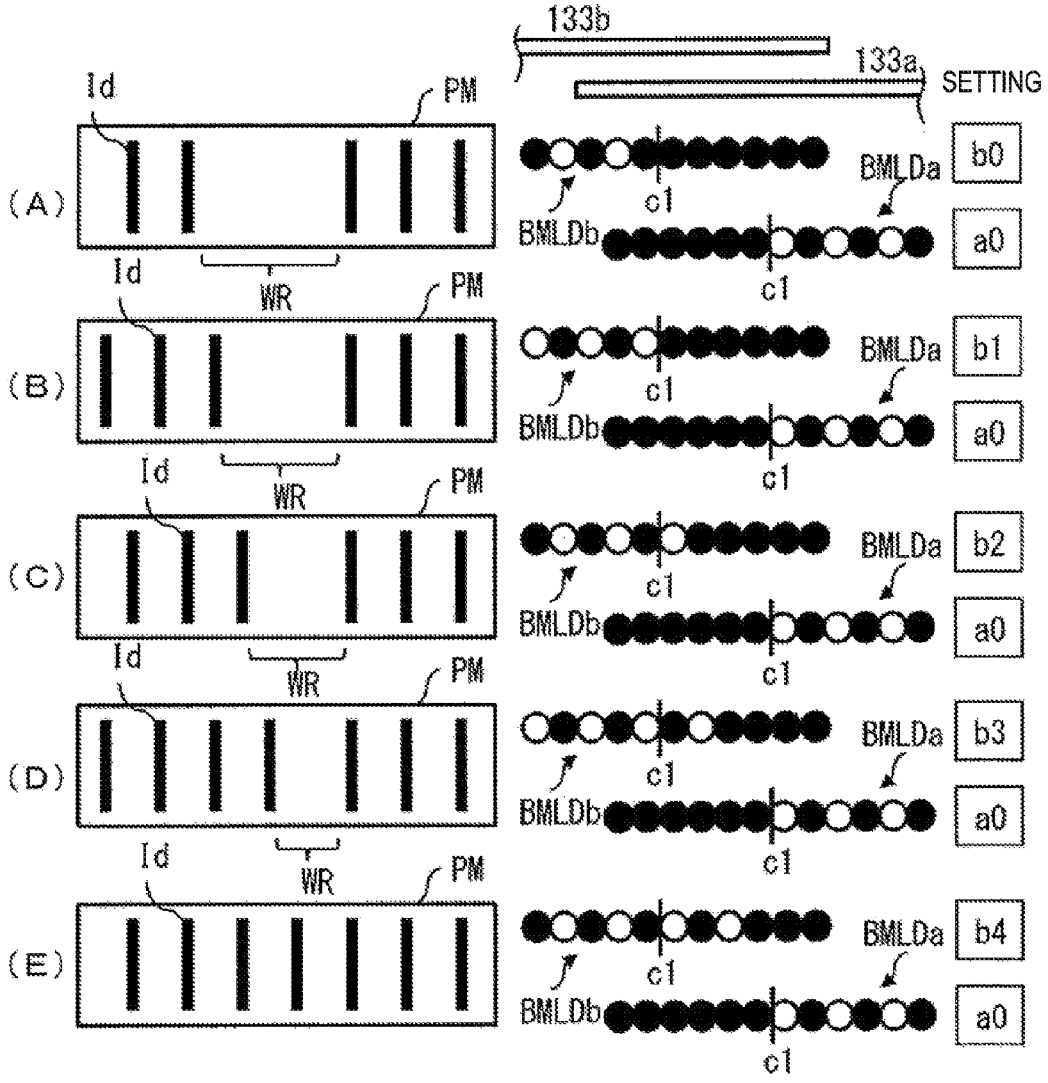
FIG. 8 shows diagrams (A) to (E) illustrating an example of a procedure of identifying an overlapping portion using a test chart.
Figure 9:
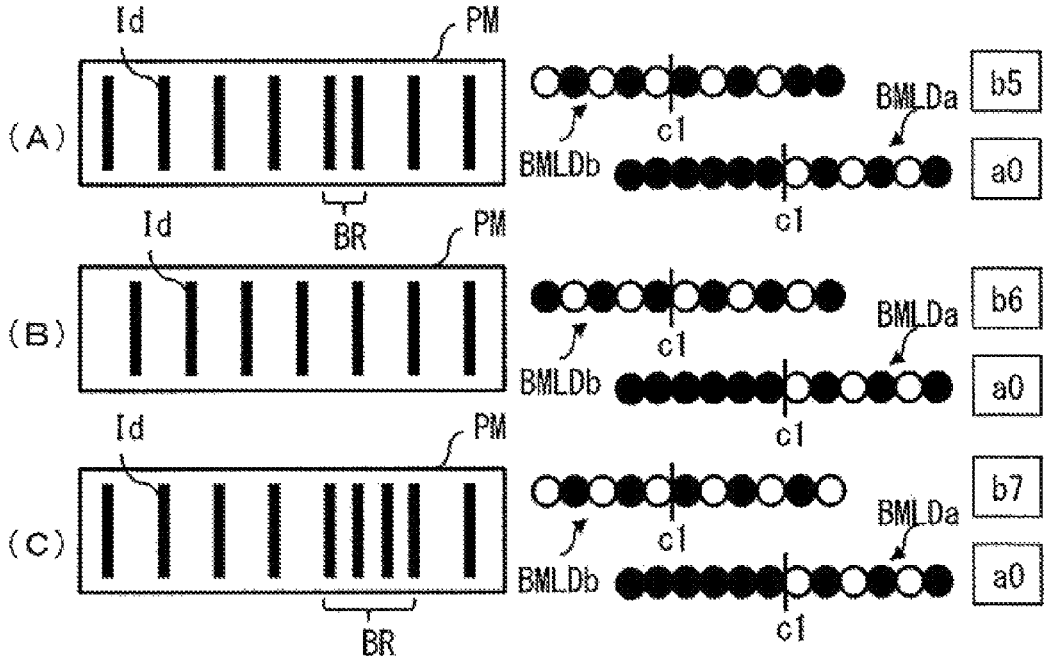
FIG. 9 shows diagrams (A) to (C) illustrating an example of a procedure subsequent to that in FIG. 8.

In FIG. 8(B), setting b1 indicates that line data BMLD2 is set as a test chart in which (N/2+1) pieces of light-emitting (white circle) pixel data and non-light-emitting (black circle) pixel data are alternately aligned. In other words, setting b1 indicates that line data BMLD that is set as the test chart in which light-emitting (white circle) pixel data and non-light-emitting (black circle) pixel data are alternately aligned is divided into two at a position on the right of logical center c1 by one pixel data. Setting b2 in FIG. 8 (C) indicates that line data BMLD2 is set as a test chart in which (N/2+2) pieces of light-emitting (white circle) pixel data and non-light-emitting (black circle) pixel data are alternately aligned. In other words, setting b2 indicates that line data BMLD that is set as the test chart in which light-emitting (white circle) pixel data and non-light-emitting (black circle) pixel data are alternately aligned is divided into two at a position on the right of logical center c1 by two pieces of pixel data. Setting b3 in FIG. 8(D) indicates that line data BMLD2 is set as a test chart in which (N/2+3) pieces of light-emitting (white circle) pixel data and non-light-emitting (black circle) pixel data are alternately aligned. In other words, setting b3 indicates that line data BMLD that is set as the test chart in which light-emitting (white circle) pixel data and non-light-emitting (black circle) pixel data are alternately aligned is divided into two at a position on the right of logical center c1 by three pieces of pixel data. Setting b4 in FIG. 8(E) indicates that line data BMLD2 is set as a test chart in which (N/2+4) pieces of light-emitting (white circle) pixel data and non-light-emitting (black circle) pixel data are alternately aligned. In other words, setting b4 indicates that line data BMLD that is set as the test chart in which light-emitting (white circle) pixel data and non-light-emitting (black circle) pixel data are alternately aligned is divided into two at a position on the right of logical center c1 by four pieces of pixel data.

Setting b5 in (A) indicates that line data BMLD2 is set as a test chart in which (N/2+5) pieces of light-emitting (white circle) pixel data and non-light-emitting (black circle) pixel data are alternately aligned. In other words, setting b5 indicates that line data BMLD that is set as the test chart in which light-emitting (white circle) pixel data and non-light-emitting (black circle) pixel data are alternately aligned is divided into two at a position on the right of logical center c1 by five pieces of pixel data. Setting b6 in FIG. 9(B) indicates that line data BMLD2 is set as a test chart in which (N/2+6) pieces of light-emitting (white circle) pixel data and non-light-emitting (black circle) pixel data are alternately aligned. In other words, setting b6 indicates that line data BMLD that is set as the test chart in which light-emitting (white circle) pixel data and non-light-emitting (black circle) pixel data are alternately aligned is divided into two at a position on the right of logical center c1 by six pieces of pixel data. Setting b7 in FIG. 9(C) indicates that line data BMLD2 is set as a test chart in which (N/2+7) pieces of light-emitting (white circle) pixel data and non-light-emitting (black circle) pixel data are alternately aligned. In other words, setting b7 indicates that line data BMLD that is set as the test chart in which light-emitting (white circle) pixel data and non-light-emitting (black circle) pixel data are alternately aligned is divided into two at a position on the right of logical center c1 by seven pieces of pixel data.

Printing is executed for each setting while the setting is sequentially changed from setting a0, b0, setting a0, b1, setting a0, b2, setting a0, b3, setting a0, b4, setting a0, b5, setting a0, b6, to setting a0, b7. In other words, printing is executed while a divided position of line data BMLD, that is set as the test chart in which light-emitting (white circle) pixel data and non-light-emitting (black circle) pixel data are alternately aligned, is shifted by one by one pixel data from the center (logical center c1). As a result, printed images as illustrated at the left sides in FIG. 8(A) to FIG. 8(E) and FIG. 9(A) to FIG. 9(C) are obtained. White region WR in the monochrome stripes is gradually narrowed at first as the setting is shifted in the abovementioned manner. Meanwhile, at setting a0, b4, white region WR disappears, and linear images Id are printed with a uniform interval. Thereafter, black region BR intermittently appears in the monochrome stripes, and black region BR in the monochrome stripes gradually spreads. From such a result, it can be said that when setting a0, b4 is set, a position on the right of a right edge of line data BMLD2 by one pixel data corresponds to a position of a left edge of line data BMLD1. This reveals that a relative position of line light emitter 133*b* with respect to line light emitter 133*a* is shifted to the left side by four pixels, compared with a case where logical center c1 and physical center c2 correspond to each other. Further, this also reveals that the number of pixels of overlapping portion OL is less by four pixels than the number of pixels of overlapping portion OL in the case where logical center c1 and physical center c2 correspond to each other. Moreover, this also reveals that physical center c2 is shifted from logical center c1 to the left side by a half of the shift amount (4 pixels/2=2 pixels). Moreover, these can identify pixel data corresponding to overlapping portion OL in bit map data BM or line data BMLD.

In this manner, printing is executed while a divided position of line data BMLD, that is set as the test chart in which light-emitting (white circle) pixel data and non-light-emitting (black circle) pixel data are alternately aligned, is shifted by one by one pixel data in the right direction or in the left direction from the center (logical center c1), thereby making it possible to identify pixel data corresponding to overlapping portion OL in bit map data BM or line data BMLD.

(Procedure (2))

Figure 10:
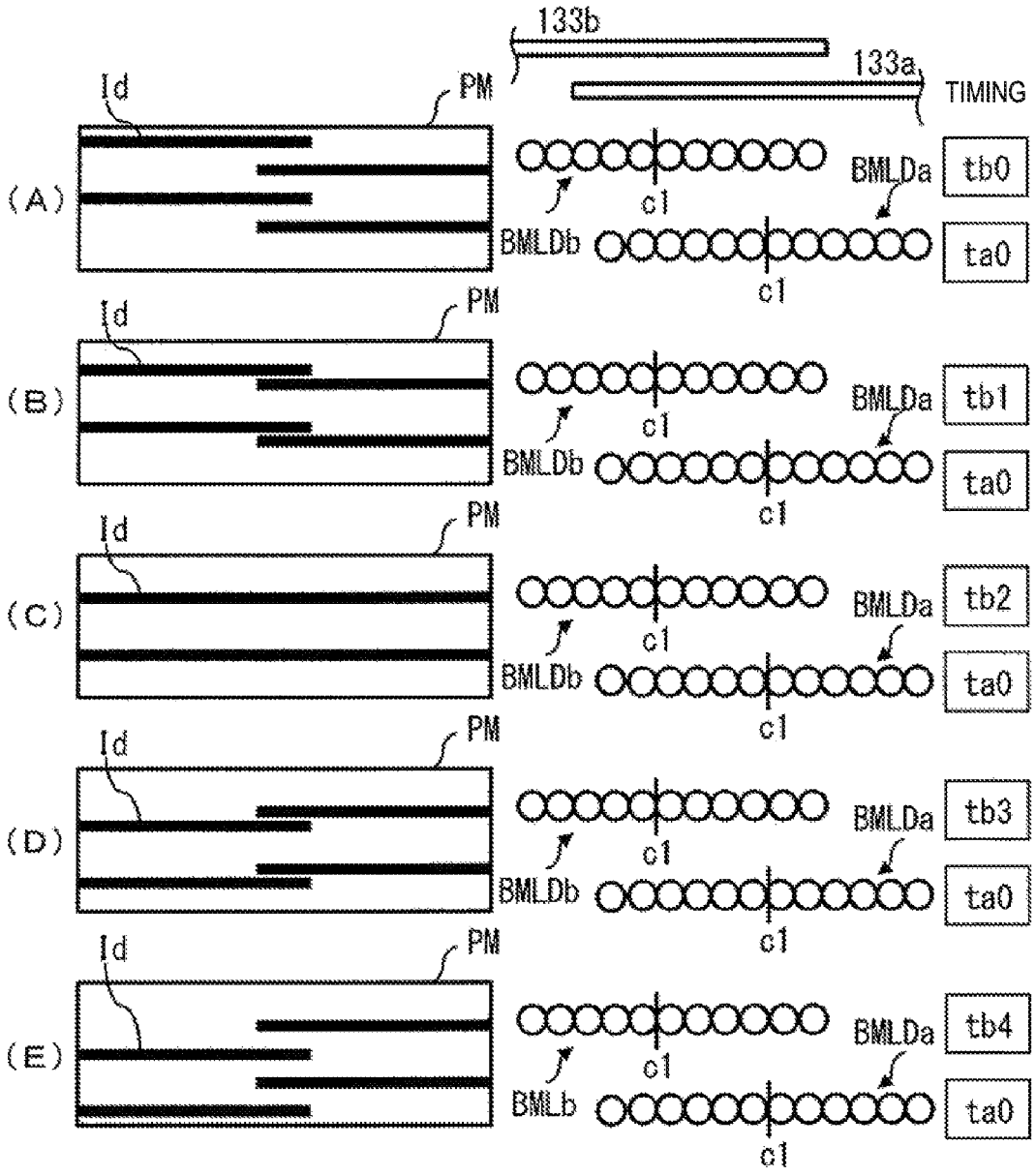
FIG. 10 shows diagrams (A) to (E) illustrating an example of a procedure of adjusting an exposure start timing using the test chart.

FIG. 10 shows diagrams (A) to (E) conceptually illustrating an example of the procedure of adjusting an exposure start timing using the test chart. In an upper right part of FIG. 10(A), schematically illustrated two line light emitters 133*a* and 133*b* are arranged in parallel such that end portions thereof are overlapped with each other in the travel direction of peripheral surface 31A. At the right sides of FIG. 10(A) to FIG. 10(E), line data BMLDa allocated to line light emitter 133*a* and line data BMLDb allocated to line light emitter 133*b* are schematically illustrated. At the left sides of FIG. 10(A) to FIG. 10(E), media PM on which multiple linear images Id are printed are schematically illustrated. In FIG. 10(A) to FIG. 10(E), timing ta0 is a light-emitting timing of line light emitter 133*a*, and is controlled by line synchronization signal 103D. In FIG. 10(A) to FIG. 10(E), timings tb0, tb1, tb2, tb3, and tb4 are light-emitting timings of line light emitter 133*b*, and are controlled by line synchronization signal 106A.

In FIG. 10(A), timing tb0 is a timing delayed by predetermined period Δt1 from timing ta0. In FIG. 10(B), timing tb1 is a timing delayed by predetermined period Δt2 (>Δt1) from timing ta0. In FIG. 10(C), timing tb2 is a timing delayed by predetermined period Δt3 (>Δt2) from timing ta0. In FIG. 10(D), timing tb3 is a timing delayed by predetermined period Δt3 (>Δt2) from timing ta0. In FIG. 10(E), timing tb4 is a timing delayed by predetermined period Δt4 (>Δt3) from timing ta0.

In FIG. 10(A) to FIG. 10(E), line data BMLD1 is set as a test chart in which all pieces of pixel data correspond to light-emitting (white circle) pixel data at timing ta0, and is set as a test chart in which all pieces of pixel data correspond to non-light-emitting (black circle) pixel data at other timings. In FIG. 10(A), line data BMLD2 is set as a test chart in which all pieces of pixel data correspond to light-emitting (white circle) pixel data at timing tb0, and is set as a test chart in which all pieces of pixel data correspond to non-light-emitting (black circle) pixel data at other timings. In FIG. 10(B), line data BMLD2 is set as a test chart in which all pieces of pixel data correspond to light-emitting (white circle) pixel data at timing tb1, and is set as a test chart in which all pieces of pixel data correspond to non-light-emitting (black circle) pixel data at other timings. In FIG. 10(C), line data BMLD2 is set as a test chart in which all pieces of pixel data correspond to light-emitting (white circle) pixel data at timing tb2, and is set as a test chart in which all pieces of pixel data correspond to non-light-emitting (black circle) pixel data at other timings. In FIG. 10(D), line data BMLD2 is set as a test chart in which all pieces of pixel data correspond to light-emitting (white circle) pixel data at timing tb3, and is set as a test chart in which all pieces of pixel data correspond to non-light-emitting (black circle) pixel data at other timings. In FIG. 10(E), line data BMLD2 is set as a test chart in which all pieces of pixel data correspond to light-emitting (white circle) pixel data at timing tb4, and is set as a test chart in which all pieces of pixel data correspond to non-light-emitting (black circle) pixel data at other timings.

Printing is executed for each set timing while an exposure start timing is sequentially changed from timing ta0, tb0, timing ta0, tb1, timing ta0, tb2, timing ta0, tb3, to timing ta0, tb4. In other words, printing is executed while a light-emitting timing of line light emitter 133*b* is gradually shifted. As a result, printed images as illustrated at the left sides in FIG. 10(A) to FIG. 10(E) are obtained. At first, intervals between linear images Id are gradually shifted as the exposure start timing is shifted in the abovementioned manner. Meanwhile, at timing ta0, tb2, linear images Id are overlapped with each other, and clear monochrome stripes appear. Thereafter, again, intervals between linear images Id are gradually shifted. Such a result reveals that when timing ta0, tb2 is set, a minimum shift in the travel direction of medium PM is obtained.

In this manner, printing is executed while a light-emitting timing of line light emitter 133*b* is gradually delayed or advanced, thereby making it possible to identify suitable light-emitting timings of line light emitters 133*a* and 133*b*. (Procedure (3))

FIG. 11A to FIG. 11F and FIG. 12A to FIG. 12D illustrate an example of the procedure of dividing line data BMLD based on a pixel pattern. FIG. 11A to FIG. 11F and FIG. 12A to FIG. 12D schematically illustrate each pixel data corresponding to overlapping portion OL (hereinafter, simply referred to as "line data of overlapping portion OL") in bit map data BM or line data BMLD. Line data of overlapping portion OL is identified in the abovementioned procedure (1), for example. Note that, in FIG. 11A to FIG. 11F and FIG. 12A to FIG. 12D, line data of overlapping portion OL is illustrated as Px(k) to Px(M).

Figure 11A:
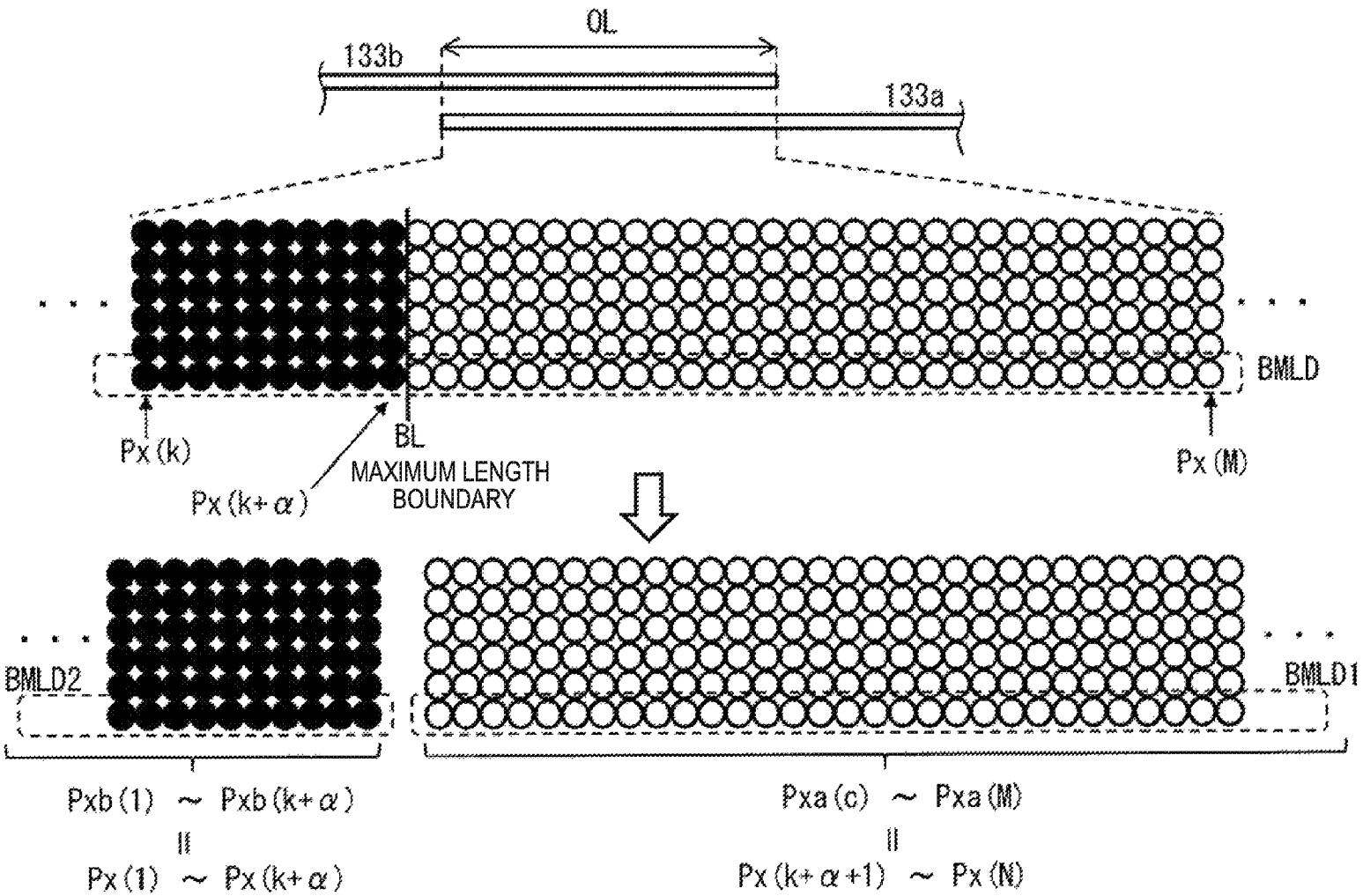
FIG. 11A is a first diagram illustrating an example of a procedure of dividing line data based on a pixel pattern.
Figure 11B:
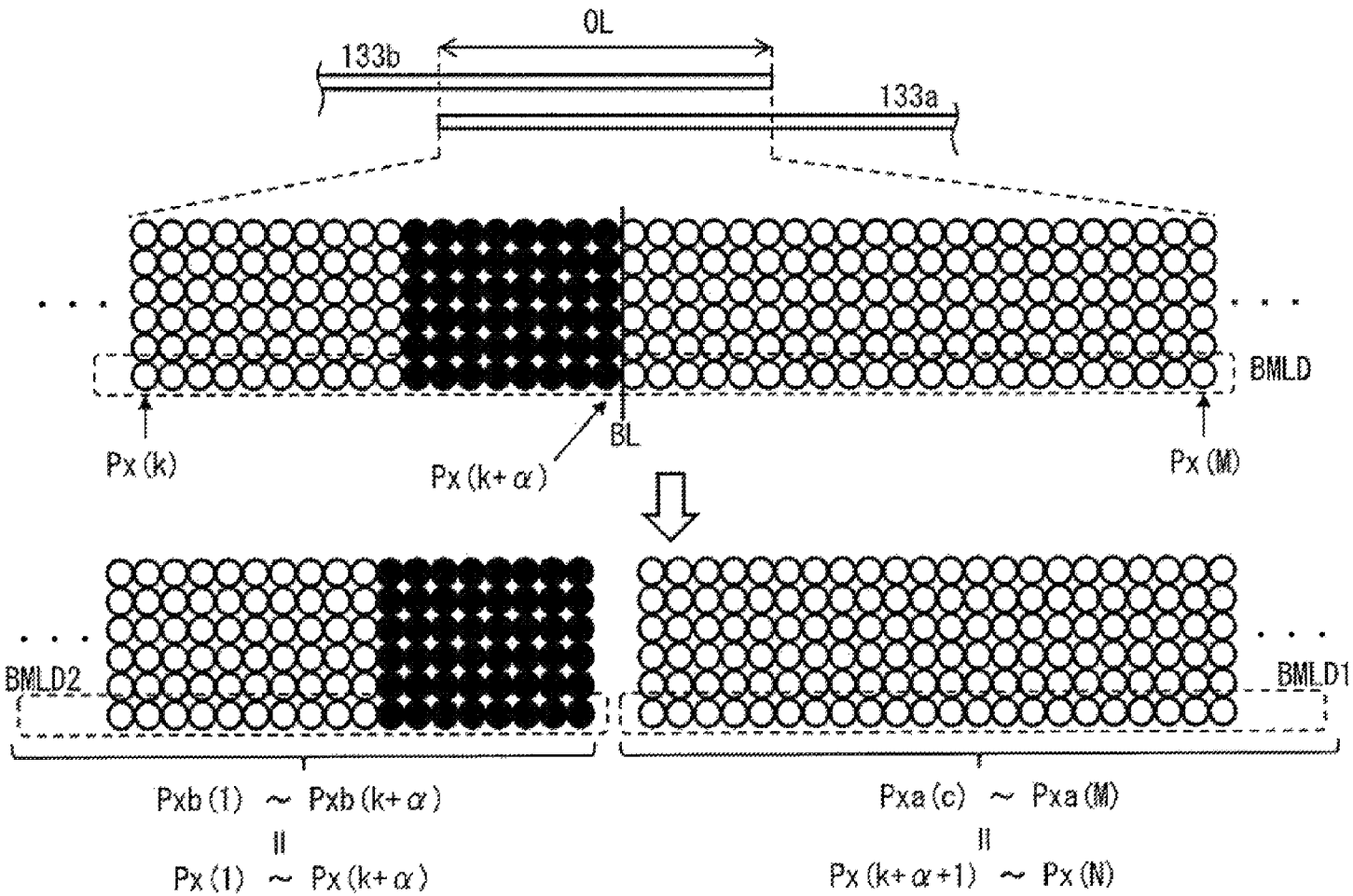
FIG. 11B is a second diagram illustrating an example of a procedure of dividing line data based on a pixel pattern.
Figure 11C:
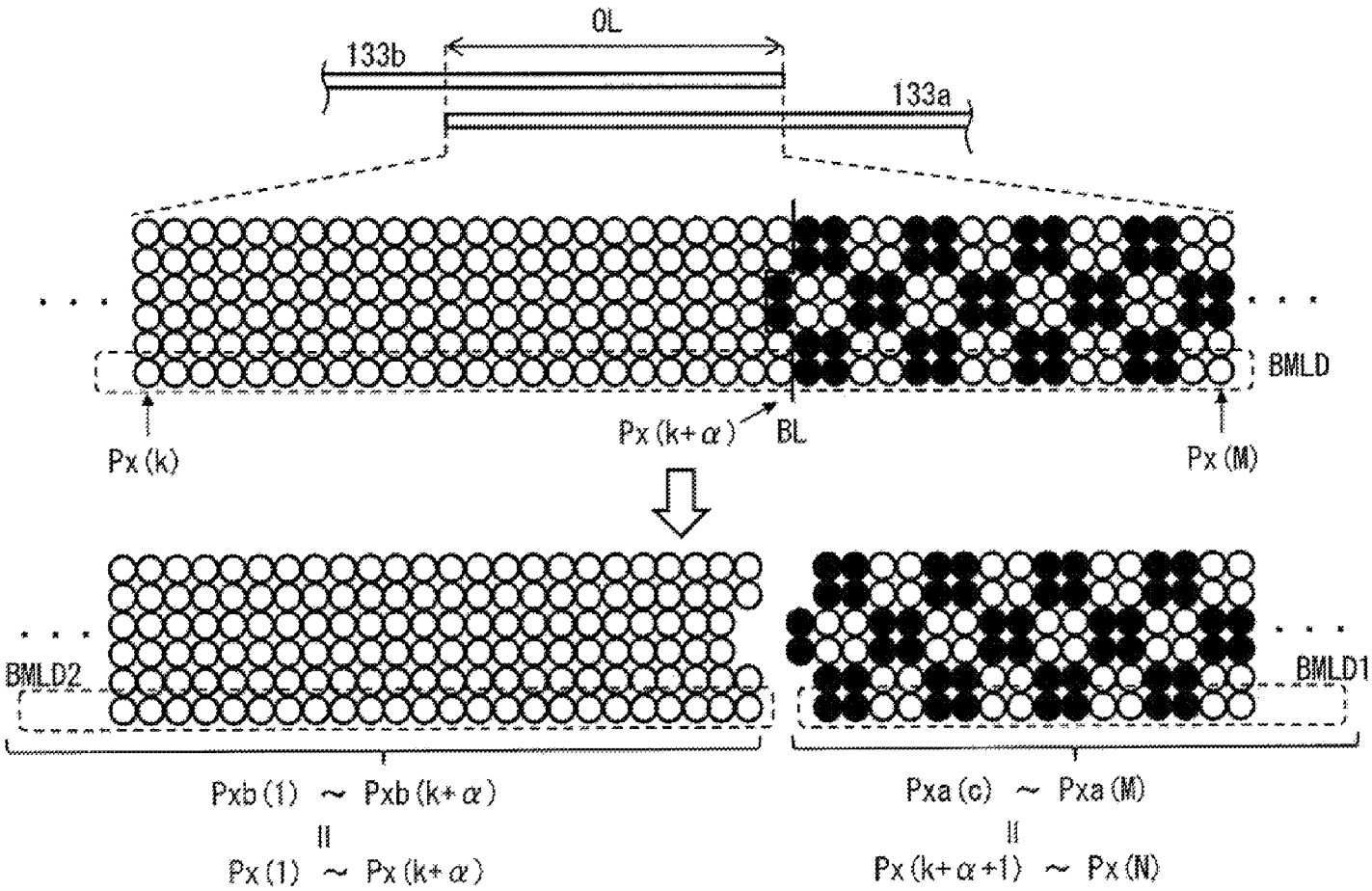
FIG. 11C is a third diagram illustrating an example of a procedure of dividing line data based on a pixel pattern.

For example, as illustrated in FIG. 11A to FIG. 11C, in line data of overlapping portion OL, it is assumed that a position where adjacent two pieces of pixel data are different from each other is present. In this case, division unit 105 firstly extracts line data BMLD for one line from bit map data BM, and divides line data BMLD into two line data BMLD1 and BMLD2 based on a pixel pattern of extracted line data BMLD. Specifically, division unit 105 firstly extracts line data BMLD for one line from bit map data BM. Then, division unit 105 sets, in multiple pieces of pixel data in overlapping portion OL (line data of overlapping portion OL) out of extracted line data BMLD, a boundary position where adjacent two pieces of pixel data are different from each other as a divided position of line data BMLD (maximum length boundary BL). Further, division unit 105 may set, in multiple pieces of pixel data corresponding to overlapping portion OL out of bit map data BM, a position where adjacent two pieces of pixel data are different from each other as a divided position of bit map data BM (maximum length boundary BL).

Here, for example, as illustrated in FIG. 11B and FIG. 11C, there is a case where multiple boundary positions where adjacent two pieces of pixel data are different from each other are present in line data of overlapping portion OL. In this case, division unit 105 may set, out of the boundary positions, a boundary position that is the farthest from an adjacent other boundary position as a divided position (maximum length boundary BL) of bit map data BM or line data BMLD. This allows bit map data BM or line data BMLD to be divided into two line data BMLD1 and BMLD2 at an outline (outer periphery) portion of a pixel pattern where a streak is inconspicuous.

Figure 11D:
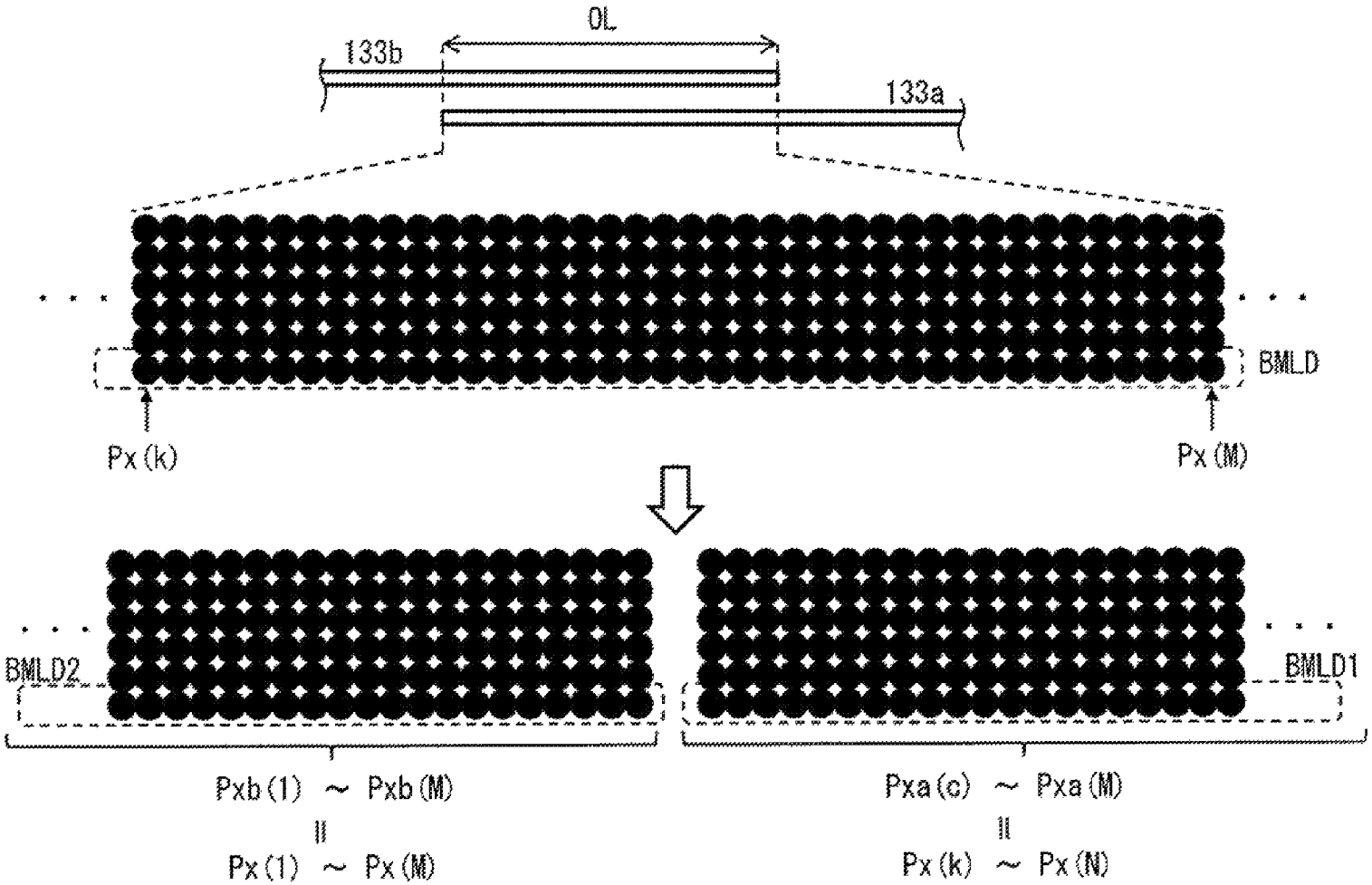
FIG. 11D is a fourth diagram illustrating an example of a procedure of dividing line data based on a pixel pattern.

For example, as illustrated in FIG. 11D, there is a case where all the line data of overlapping portion OL is non-light-emitting corresponded data. In this case, for example, division unit 105 sets, in multiple pieces of pixel data corresponding to overlapping portion OL (line data of overlapping portion OL) out of bit map data BM or line data BMLD, an arbitrary position as a divided position (maximum length boundary BL) of bit map data BM or line data BMLD as illustrated in FIG. 11D. In this process, division unit 105 may set logical center c1 as a divided position of bit map data BM or line data BMLD, in line data of overlapping portion OL. Moreover, when division unit 105 stores therein a divided position (maximum length boundary BL) set in the last line data BMLD, division unit 105 may set the stored divided position (maximum length boundary BL) or a boundary position closest to the stored divided position (maximum length boundary BL) as a divided position (maximum length boundary BL) in next line data BMLD.

Figure 11E:
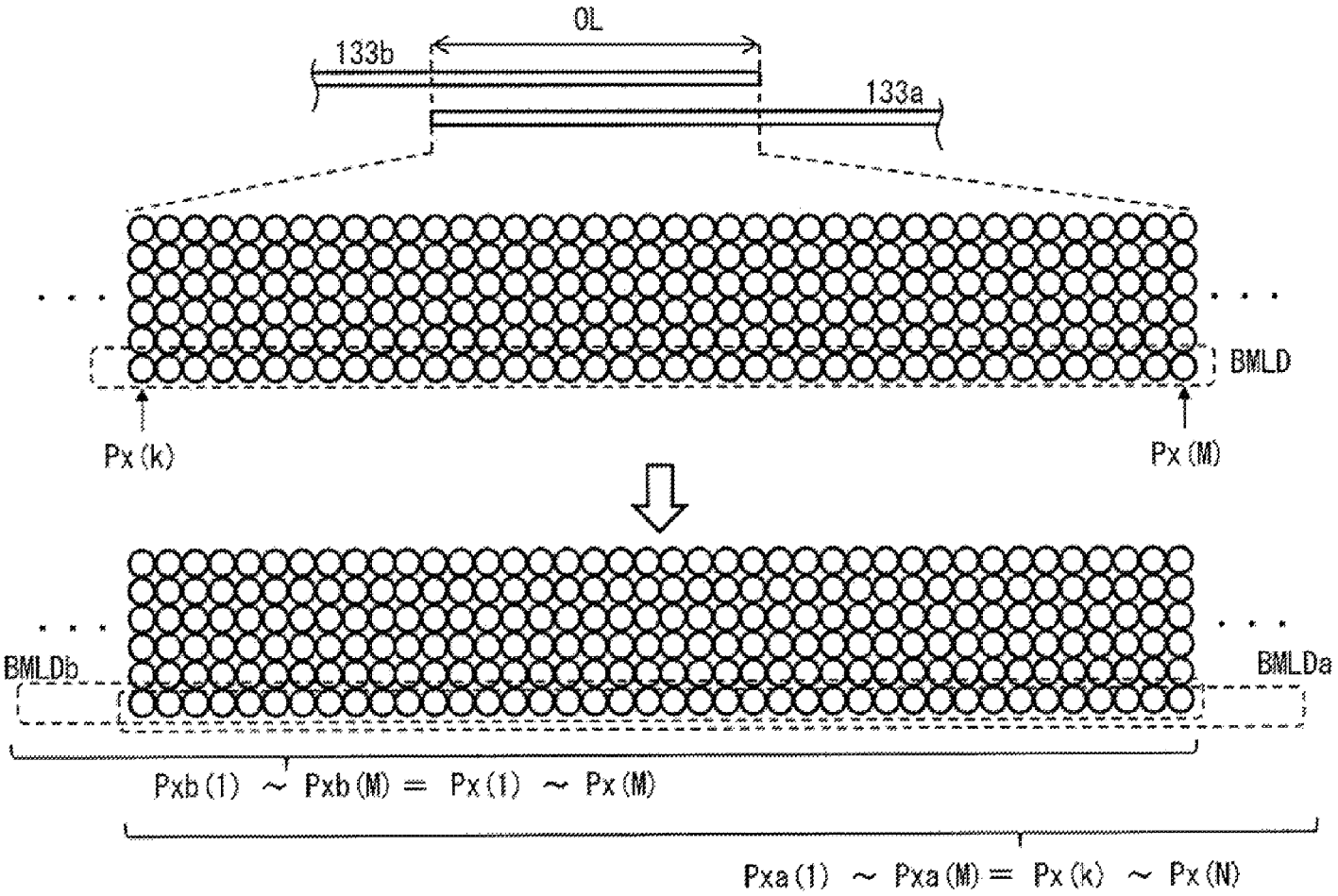
FIG. 11E is a fifth diagram illustrating an example of a procedure of dividing line data based on a pixel pattern.

In a case where all the line data of overlapping portion OL is light-emitting corresponded data, division unit 105 may set, for example, as illustrated in FIG. 11E, in line data BMLDa and line data BMLDb, all the pixel data corresponding to overlapping portion OL as light-emitting corresponded data. In other words, in this case, control board 100 outputs a control signal that causes all the portions corresponding to overlapping portion OL, in line light emitters 133*a* and 133*b*, to emit light.

Figure 11F:
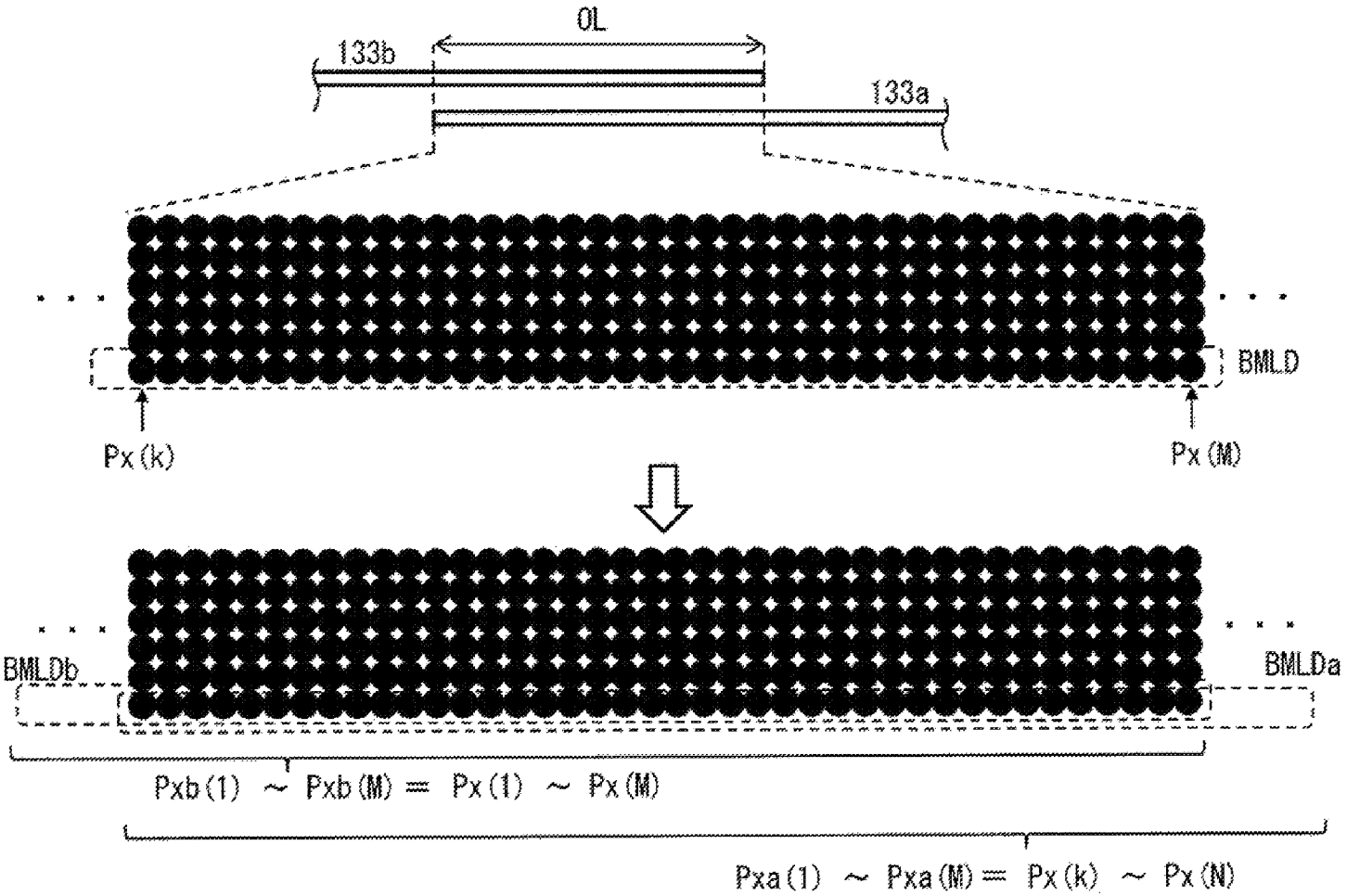
FIG. 11F is a sixth diagram illustrating an example of a procedure of dividing line data based on a pixel pattern.
Figure 12A:
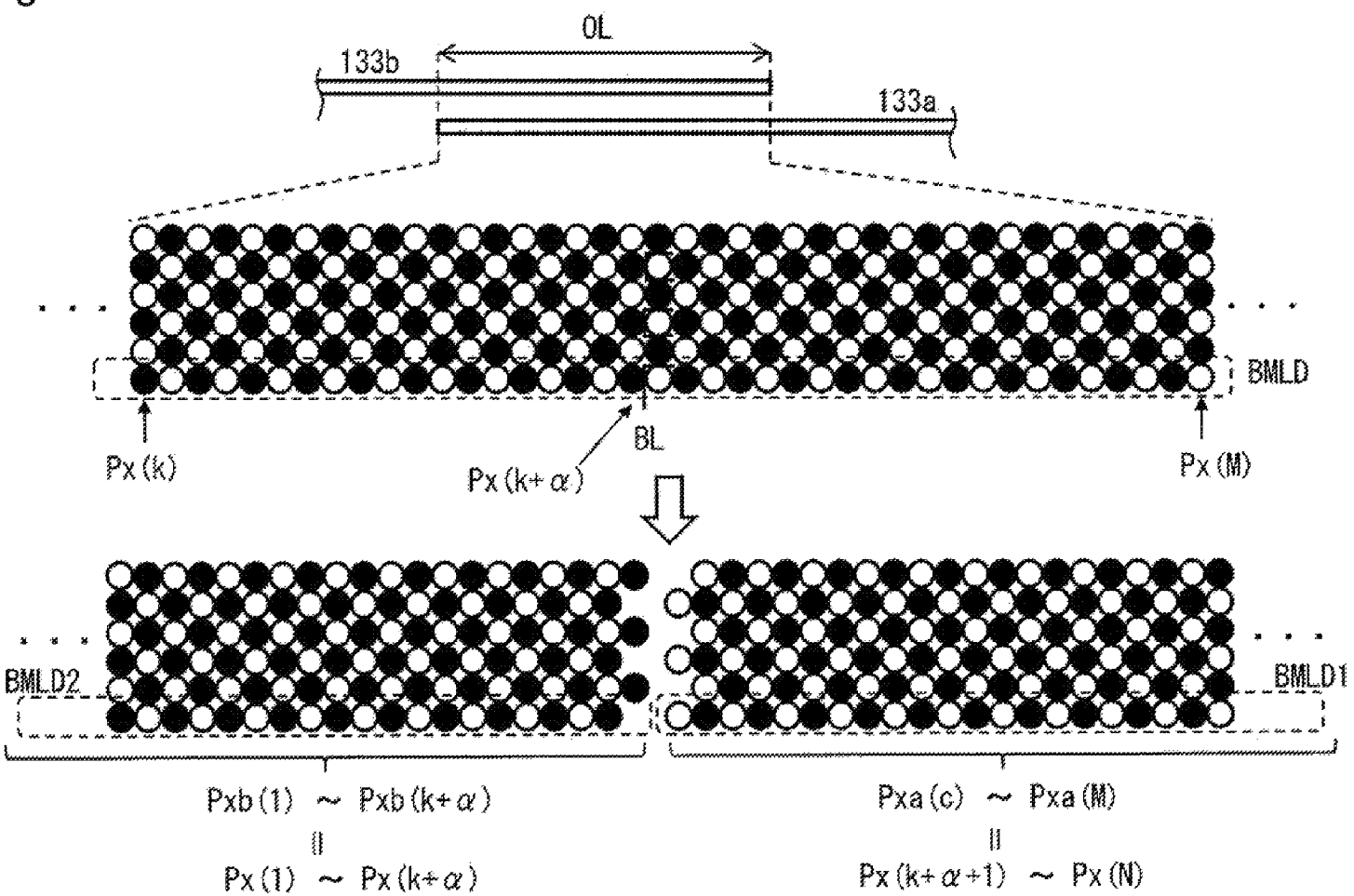
FIG. 12A is a first diagram illustrating an example of a procedure of dividing line data based on a pixel pattern.
Figure 12B:
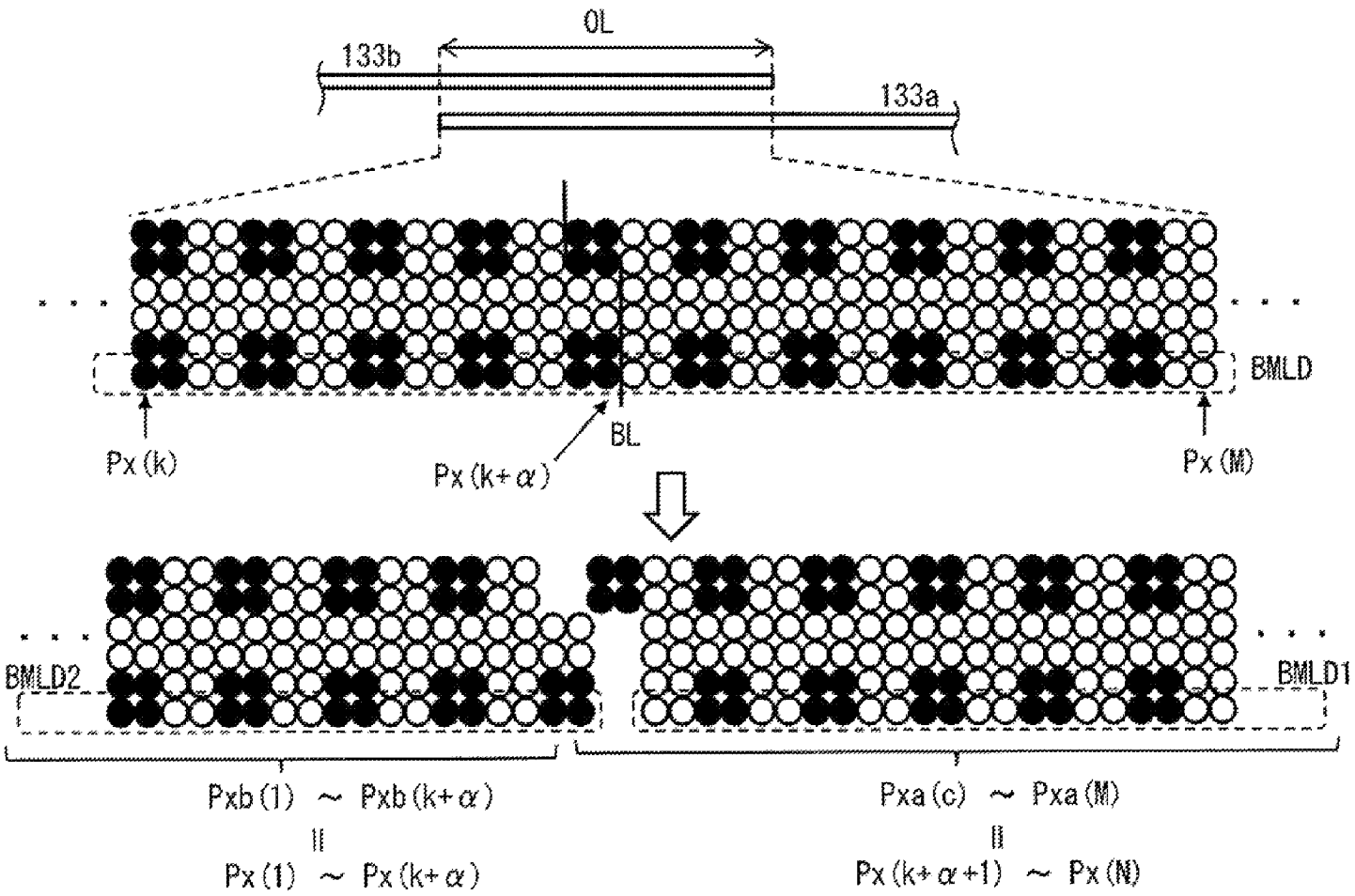
FIG. 12B is a second diagram illustrating an example of a procedure of dividing line data based on a pixel pattern.
Figure 12C:
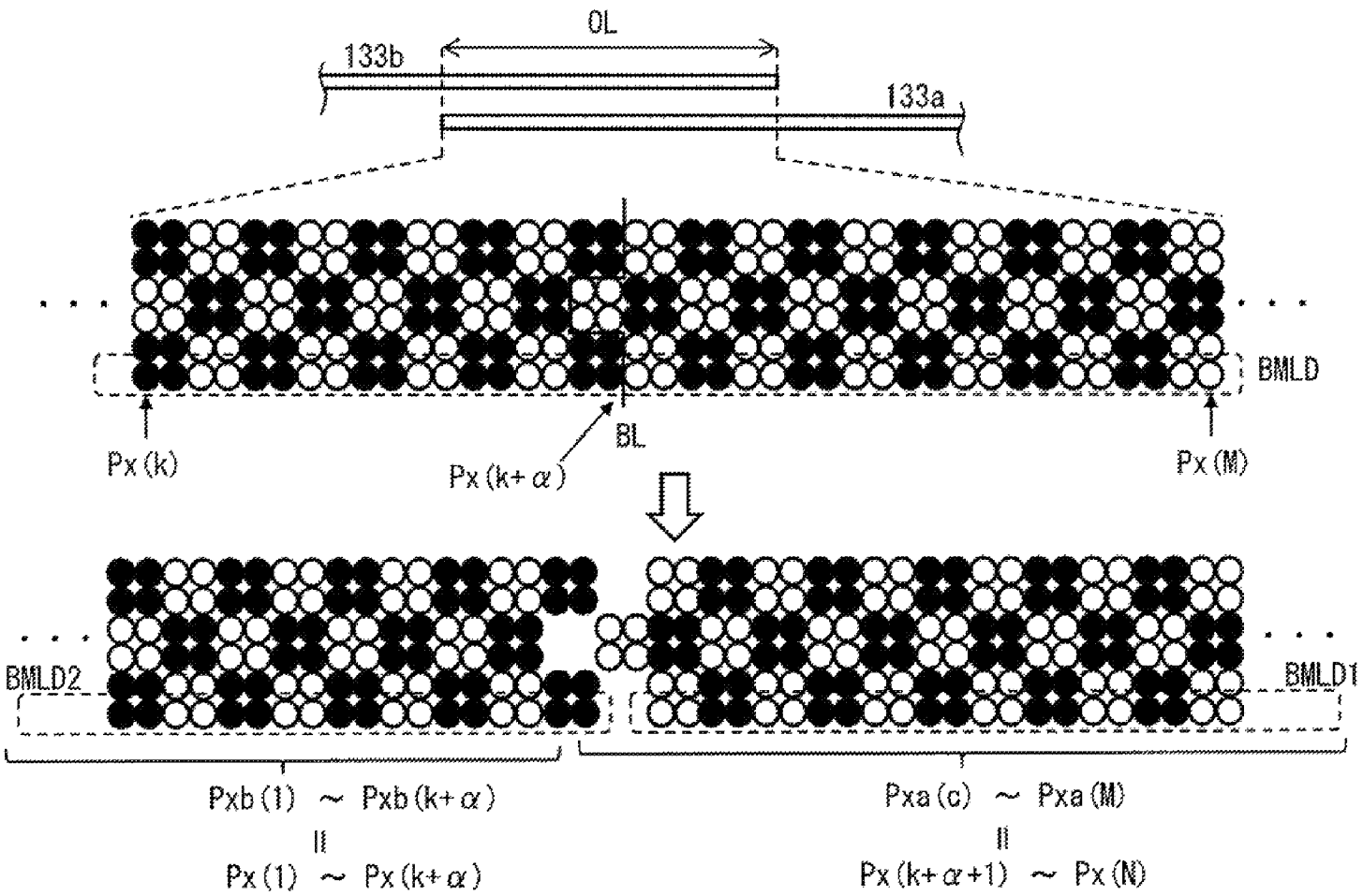
FIG. 12C is a third diagram illustrating an example of a procedure of dividing line data based on a pixel pattern.
Figure 12D:
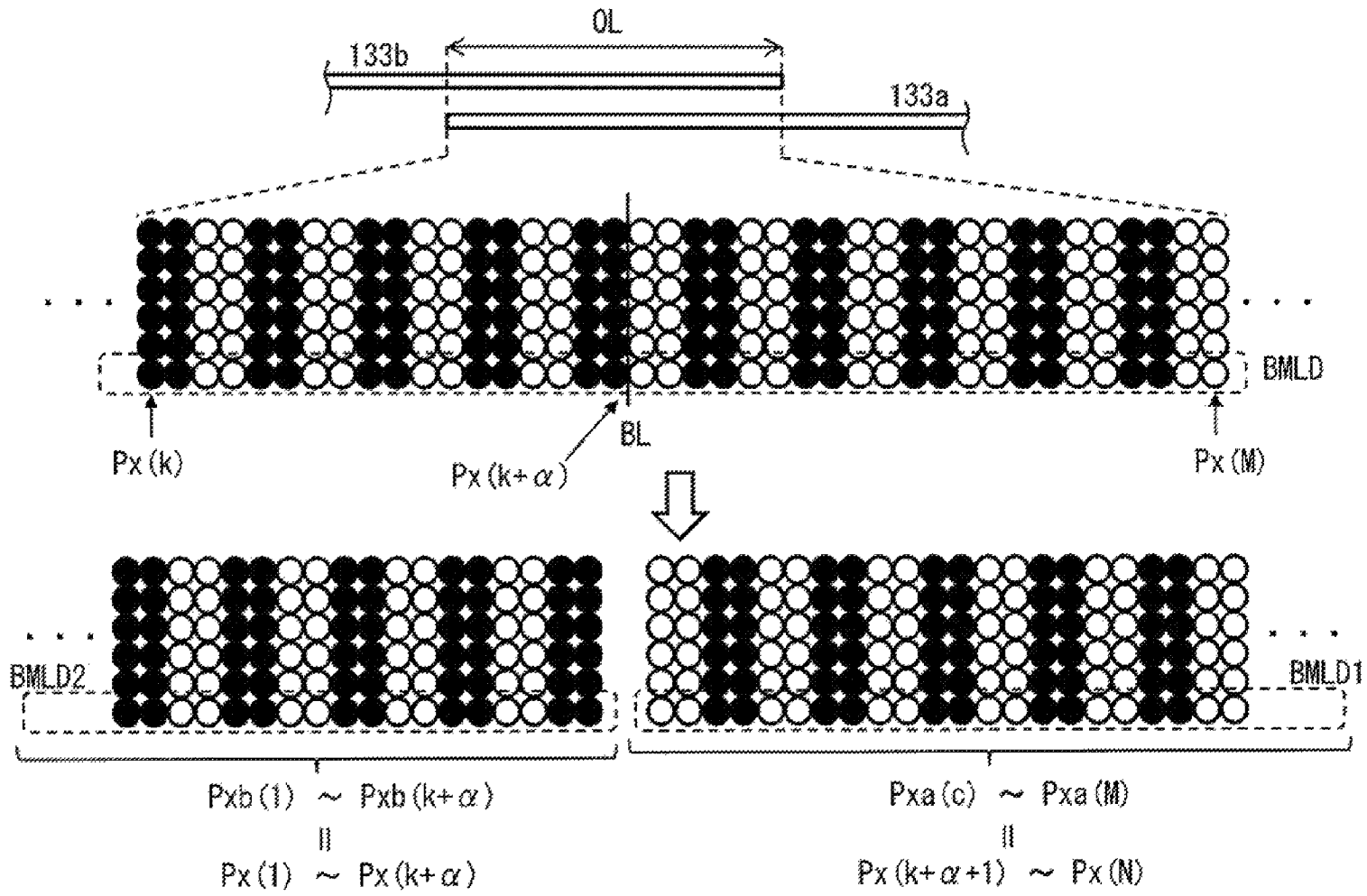
FIG. 12D is a fourth diagram illustrating an example of a procedure of dividing line data based on a pixel pattern.

As a modification example of the case where all the line data of overlapping portion OL is non-light-emitting corresponded data, division unit 105 sets, for example, as illustrated in FIG. 11F, in line data BMLDa and line data BMLDb, all the pixel data corresponding to overlapping portion OL as non-light-emitting corresponded data. In other words, in this case, control board 100 outputs a control signal that causes all the portions corresponding to overlapping portion OL, in line light emitters 133*a* and 133*b*, not to emit light.

Moreover, for example, as illustrated in FIG. 12A to FIG. 12D, in line data of overlapping portion OL, there is a case where multiple boundary positions where adjacent two pieces of pixel data are different from each other are present, and multiple boundary positions correspond to boundary positions farthest from an adjacent other boundary position. In this case, division unit 105 may set, out of each pixel data corresponding to overlapping portion OL in bit map data BM or line data BMLD, a boundary position closest to logical center c1 as a divided position (maximum length boundary BL) of bit map data BM or line data BMLD. Moreover, when division unit 105 stores therein a divided position (maximum length boundary BL) set in the last line data BMLD, division unit 105 may set the stored divided position (maximum length boundary BL) or a boundary position closest to the stored divided position (maximum length boundary BL) as a divided position (maximum length boundary BL) in next line data BMLD. In this process, division unit 105 may set a divided position (maximum length boundary BL) by referring to a pixel pattern of the last line data of overlapping portion OL. For example, when a pixel pattern of current line data of overlapping portion OL matches a pixel pattern of the last line data of overlapping portion OL, division unit 105 may set the last divided position (maximum length boundary BL) as a current divided position (maximum length boundary BL). For example, when a pixel pattern of current line data of overlapping portion OL does not match a pixel pattern of the last line data of overlapping portion OL, division unit 105 may arbitrarily select any of multiple boundary positions as a divided position (maximum length boundary BL).

Figure 13:
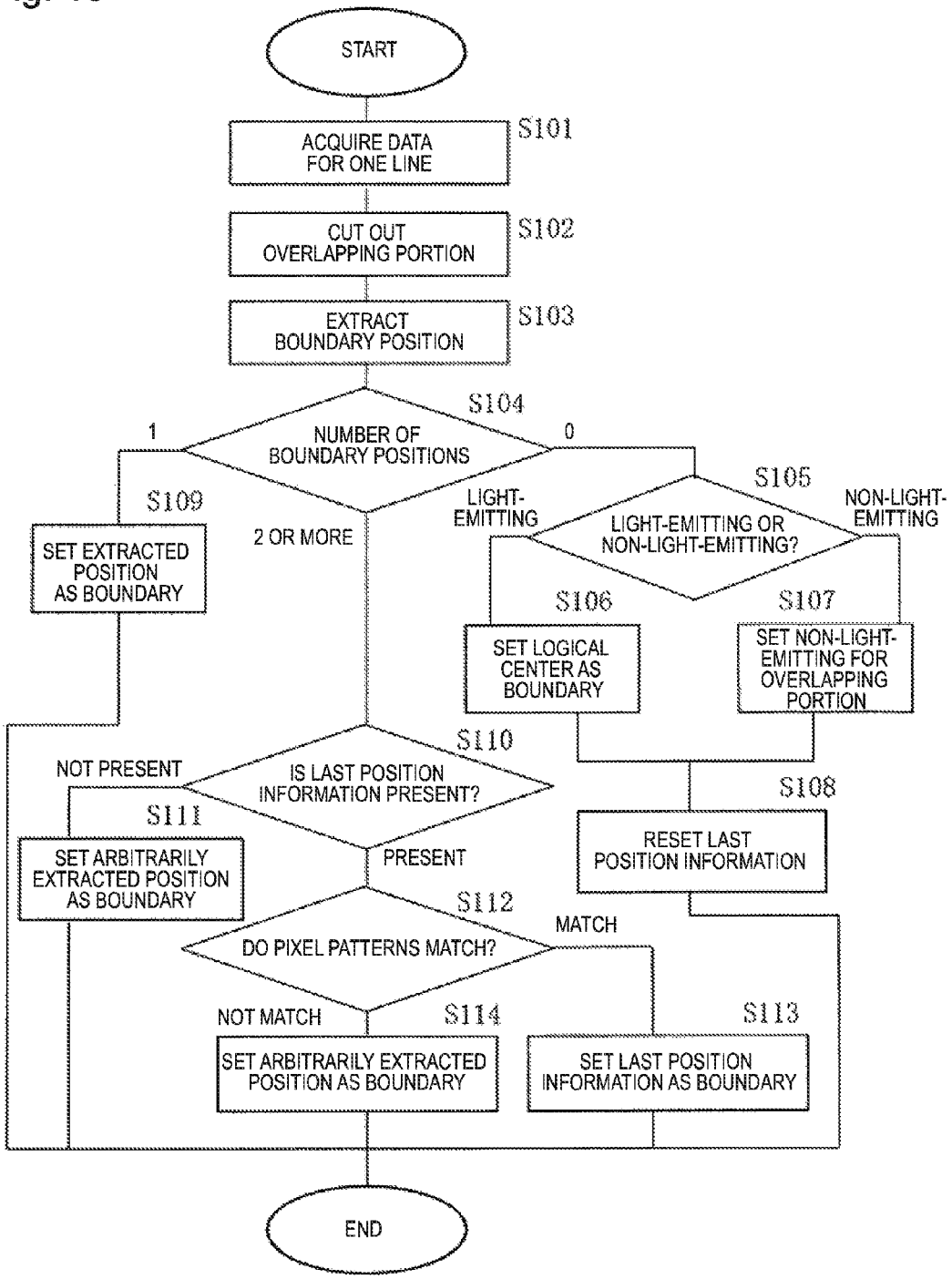
FIG. 13 is a flowchart illustrating an example of a division procedure of line data.

FIG. 13 illustrates an example of a division procedure of line data BMLD. Division unit 105 firstly extracts line data BMLD for one line from bit map data BM (Step S101). Next, division unit 105 cuts out multiple pieces of pixel data corresponding to overlapping portion OL (line data of overlapping portion OL) out of extracted line data BMLD (Step S102).

Next, division unit 105 extracts a boundary position where adjacent two pieces of pixel data are different from each other in line data of overlapping portion OL (Step S103). Next, division unit 105 counts the number of boundary positions (Step S104). As a result of the counting, if the number of boundary positions is zero, division unit 105 determines whether all the line data of overlapping portion OL is configured by light-emitting (white circle) corresponded data or non-light-emitting (black circle) corresponded data (Step S105). As a result of the determination, if all the line data of overlapping portion OL is configured by the light-emitting corresponded data, division unit 105 sets, for example, logical center c1 as a divided position (maximum length boundary BL) (Step S106). If all the line data of overlapping portion OL is configured by the non-light-emitting corresponded data, division unit 105 sets all the pixel data corresponding to overlapping portion OL as non-light-emitting corresponded data in line data BMLDa and line data BMLDb (Step S107). Thereafter, division unit 105 resets information related to the last divided position (maximum length boundary BL) (Step S108).

If the number of boundary positions is one at Step S104, division unit 105 sets one extracted boundary position as a divided position (maximum length boundary BL) (Step S109). If the number of boundary positions is two or more at Step S104, division unit 105 determines whether information related to the last divided position (maximum length boundary BL) is present (Step S110). As a result of the determination, if no information related to the last divided position (maximum length boundary BL) is present, division unit 105 arbitrarily selects any of the searched multiple boundary positions as a divided position (maximum length boundary BL) (Step S111). If information related to the last divided position (maximum length boundary BL) is present, division unit 105 determines whether a pixel pattern of current line data of overlapping portion OL matches a pixel pattern of the last line data of overlapping portion OL (Step S112). As a result of the determination, if a pixel pattern of current line data of overlapping portion OL matches a pixel pattern of the last line data of overlapping portion OL, division unit 105 sets the last divided position (maximum length boundary BL) as the current divided position (maximum length boundary BL) (Step S113). If a pixel pattern of current line data of overlapping portion OL does not match a pixel pattern of the last line data of overlapping portion OL, division unit 105 arbitrarily selects any of the multiple searched boundary positions as a divided position (maximum length boundary BL) (Step S114). In this manner, line data BMLD is divided into two line data BMLD1 and BMLD2.

[Effect]

Next, an effect of image formation apparatus 1 is described.

Generally, as for a method that allows printing of a large-sized image, for example, it can be considered to use: a wide exposure head that has a width equivalent to the width of the printing paper; or an exposure head module that has a width equivalent to the width of the printing paper with multiple narrow exposure heads being arranged in parallel. However, the wide exposure head lacks a general-purpose property because the wide exposure head cannot be used in an image formation apparatus for normal size printing. Meanwhile, the exposure head module might generate a streak at a position corresponding to a connected portion between the adjacent exposure heads thereof when printing is executed. Adjusting positions, exposure timings, and the like of the respective exposure heads allows the streak to be invisible to some extent. However, making the streak be inconspicuous is extremely difficult.

Meanwhile, with image formation apparatus 1 in this embodiment, bit map data BM or line data BMLD is divided into line data BMLD1 and line data BMLD2 based on a pixel pattern of bit map data BM or line data BMLD. This allows bit map data BM or line data BMLD to be divided into two line data BMLD1 and BMLD2 at an outline (outer periphery) portion of a pixel pattern where a streak is inconspicuous. As a result, it is possible to make the streak be inconspicuous.

Hereinafter, an image formation apparatus and a light-emitting apparatus according to other embodiments of the invention are described. Note that, hereinafter, the components common to those in the above-mentioned embodiment are assigned with the same reference numerals that are assigned in the above-mentioned embodiment. Moreover, explanations are made mainly to the components that are different from those in the above-mentioned embodiment, and explanations for the components common to those in the above-mentioned embodiment are omitted, as appropriate.

<2. Second Embodiment>

Figure 14:
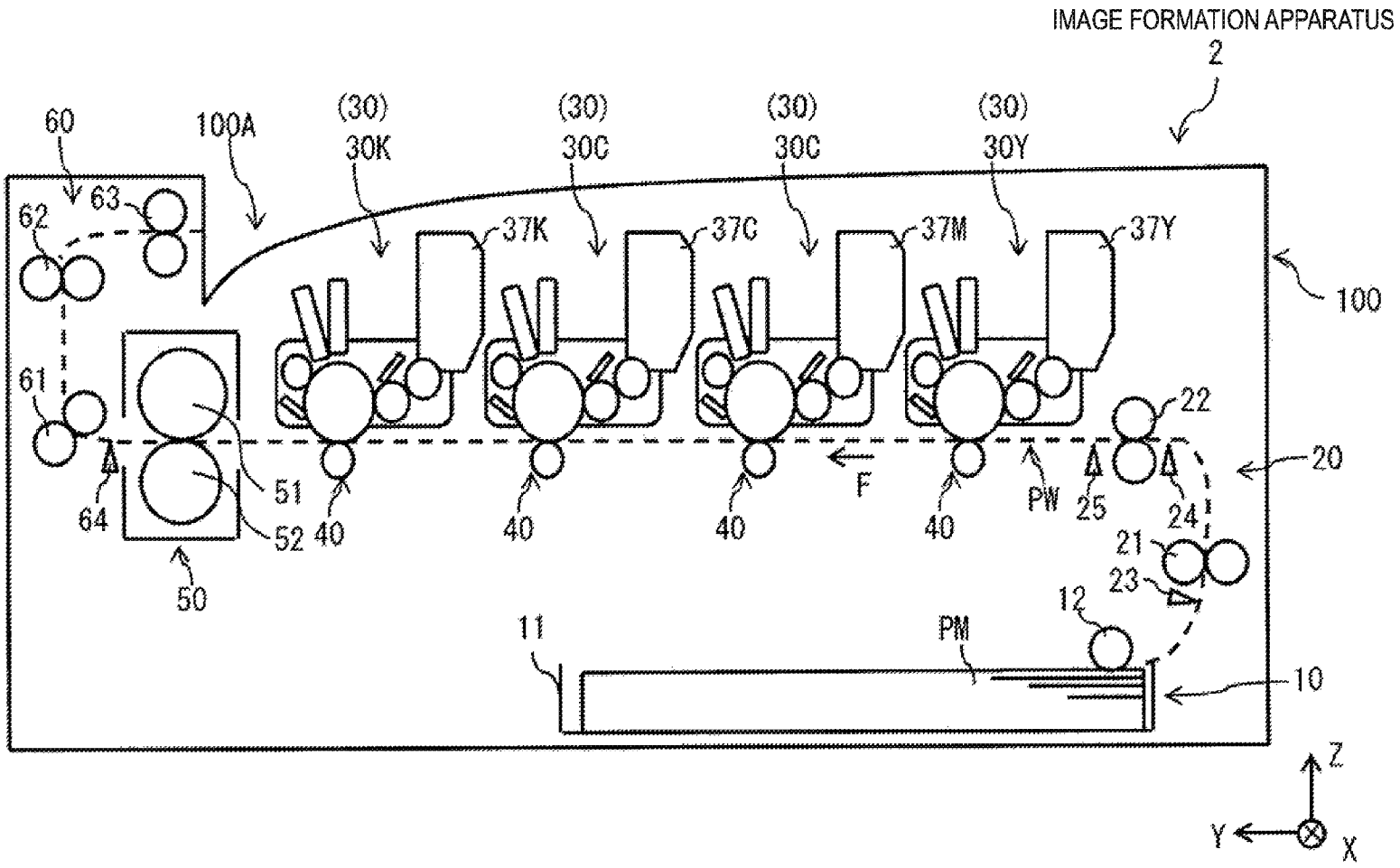
FIG. 14 is a diagram illustrating a schematic configuration example of an image formation apparatus according to a second embodiment of the invention.

Next, image formation apparatus 2 according to a second embodiment of the invention is described. FIG. 14 illustrates a schematic configuration example of image formation apparatus 2. Image formation apparatus 2 corresponds to an image formation apparatus in which multiple image formation units 30 are provided in image formation apparatus 1. As illustrated in FIG. 14, image formation apparatus 2 is provided with, for example, four image formation units 30 (30Y, 30M, 30C, and 30K) that are arranged along conveyance path PW. Four image formation units 30 (30Y, 30M, 30C, and 30K) use toner of respective colors, in other words, yellow toner, magenta toner, cyan toner, and black toner to form toner images (images) of the respective colors. Four image formation units 30 (30Y, 30M, 30C, and 30K) are sequentially placed, for example, towards conveyance direction F, in the order of image formation unit 30Y, image formation unit 30M, image formation unit 30C, and image formation unit 30K.

"Procedure (1) and Procedure (2)" in the above-mentioned embodiment are executed to respective image formation units 30 (30Y, 30M, 30C, and 30K). Division unit 105 divides bit map data BM or line data BMLD based on a pixel pattern of bit map data BM or line data BMLD of a color corresponding to any one of image formation units 30, out of the four image formation units 30 (30Y, 30M, 30C, and 30K). In other words, in this embodiment, division unit 105 executes "Procedure (3)" in the above-mentioned embodiment using bit map data BM or line data BMLD of a color corresponding to anyone of image formation units 30, out of the four image formation units 30 (30Y, 30M, 30C, and 30K). Further, depending on the pixel patterns of the respective colors in bit map data BM or line data BMLD, there is a case where division unit 105 may divide bit map data BM or line data BMLD based on a pixel pattern of bit map data BM or line data BMLD of a color corresponding to at least one of image formation units 30, out of the four image formation units 30 (30Y, 30M, 30C, and 30K).

Similar to image formation apparatus 1 in the above-mentioned embodiment, bit map data BM or line data BMLD is divided into line data BMLD1 and line data BMLD2 based on a pixel pattern of bit map data BM or line data BMLD with image formation apparatus 2 in this embodiment. This allows bit map data BM or line data BMLD to be divided into two line data BMLD1 and BMLD2 at an outline (outer periphery) portion of a pixel pattern where a streak is inconspicuous. As a result, it is possible to make the streak be inconspicuous.

<3. Third Embodiment>

Figure 15:
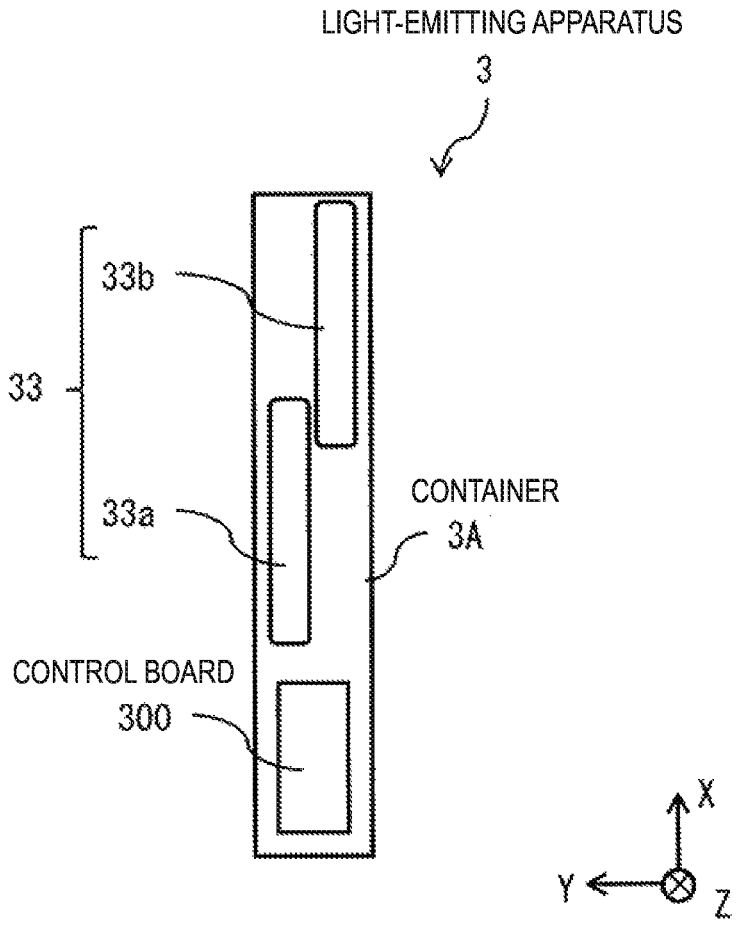
FIG. 15 is a diagram illustrating a schematic configuration example of a light-emitting apparatus according to a third embodiment of the invention.
Figure 16:
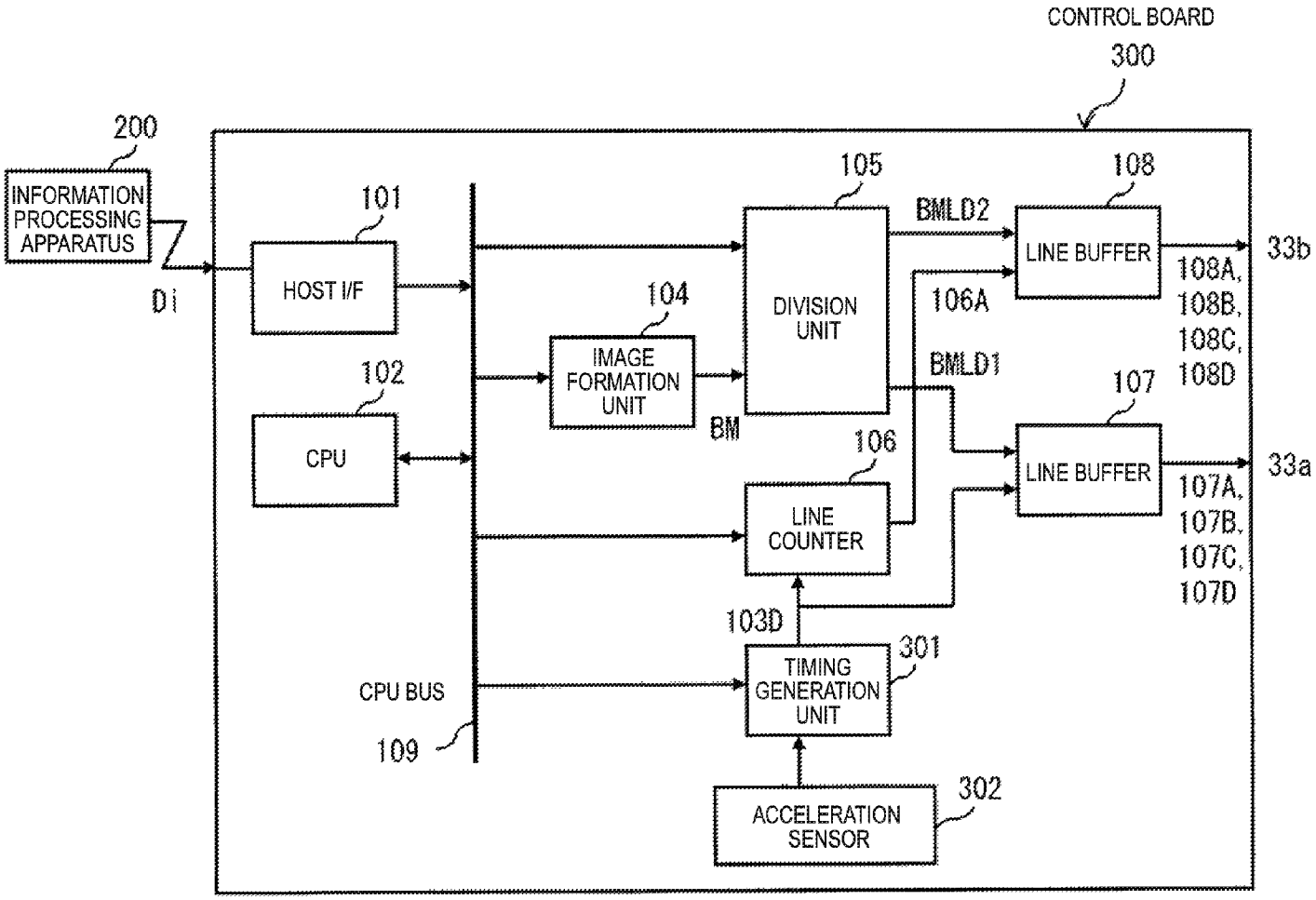
FIG. 16 is a diagram illustrating a function block example of a control board in the light-emitting apparatus in FIG. 15.

Next, light-emitting apparatus 3 according to a third embodiment of the invention is described. FIG. 15 illustrates a schematic configuration example of light-emitting apparatus 3. Light-emitting apparatus 3 is a display apparatus that uses an afterimage effect, and is provided with LED head module 33, and control board 300 that controls LED head module 33, for example. LED head module 33 and control board 300 are contained in container 3A, for example. As illustrated in FIG. 16, control substrate 300 corresponds to a control board in which timing generation unit 301 and acceleration sensor 302 are provided, instead of mechanism controller 103 in control board 100 as in the above-mentioned embodiment, for example. Further, acceleration sensor 302 can be omitted if necessary.

Timing generation unit 301 generates line synchronization signal 103D based on a control signal from CPU 102 and a detection signal inputted from acceleration sensor 302, for example, and outputs line synchronization signals 103D to line counter 106 and line buffer 107. The control signal from CPU 102 includes a setting value (such as timing ta0) related to a timing of outputting head data 107B. Further, in a case where acceleration sensor 302 is omitted, timing generation unit 301 generates line synchronization signal 103D based on, for example, a control signal from CPU 102, and outputs line synchronization signals 103D to line counter 106 and line buffer 107. When light-emitting apparatus 3 cyclically vibrates or rotates by an external force, acceleration sensor 302 detects the vibration or the rotation and outputs a detected result as a detection signal to timing generation unit 301.

When light-emitting apparatus 3 cyclically vibrates by a person or a vibration device, or rotates by being attached to a tire portion of a vehicle, for example, LED head module 33 successively outputs light of multiple segments (video image for one line) in which a video image is divided. This causes the person to recognize past light having been outputted from light-emitting apparatus 3 as an afterimage, and accordingly to recognize a video image being projected in a region where light-emitting apparatus 3 cyclically vibrates or rotates.

Similar to image formation apparatus 1 in the abovementioned embodiment, bit map data BM or line data BMLD is divided into line data BMLD1 and line data BMLD2 based on a pixel pattern of bit map data BM or line data BMLD with light-emitting apparatus 3 in this embodiment. This allows bit map data BM or line data BMLD to be divided into two line data BMLD1 and BMLD2 at an outline (outer periphery) portion of a pixel pattern where a streak is inconspicuous. As a result, it is possible to make the streak be inconspicuous in the video image.

<4. Fourth Embodiment>

Figure 17:
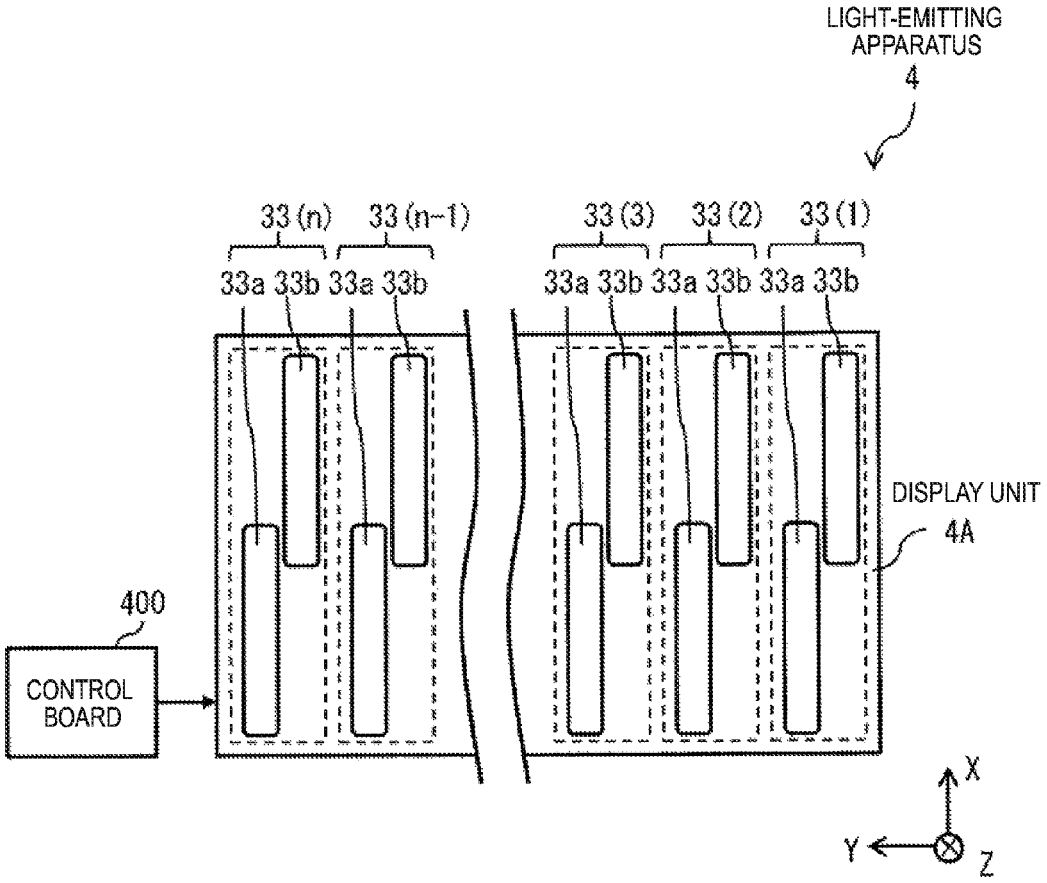
FIG. 17 is a diagram illustrating a schematic configuration example of a light-emitting apparatus according to a fourth embodiment of the invention.

Next, light-emitting apparatus 4 according to a fourth embodiment of the invention is described. FIG. 17 illustrates a schematic configuration example of light-emitting apparatus 4. Light-emitting apparatus 4 is a display apparatus that uses an afterimage effect, and is provided with multiple LED head modules 33 and control board 400 that controls multiple LED head modules 33, for example. Multiple LED head modules 33 are regularly placed such that longitudinal directions thereof direct the same direction with each other, for example, and are arranged in a row such that end portions thereof are aligned with each other. With such a placement, multiple LED head modules 33 function as display unit 4A in light-emitting apparatus 4.

Figure 18:
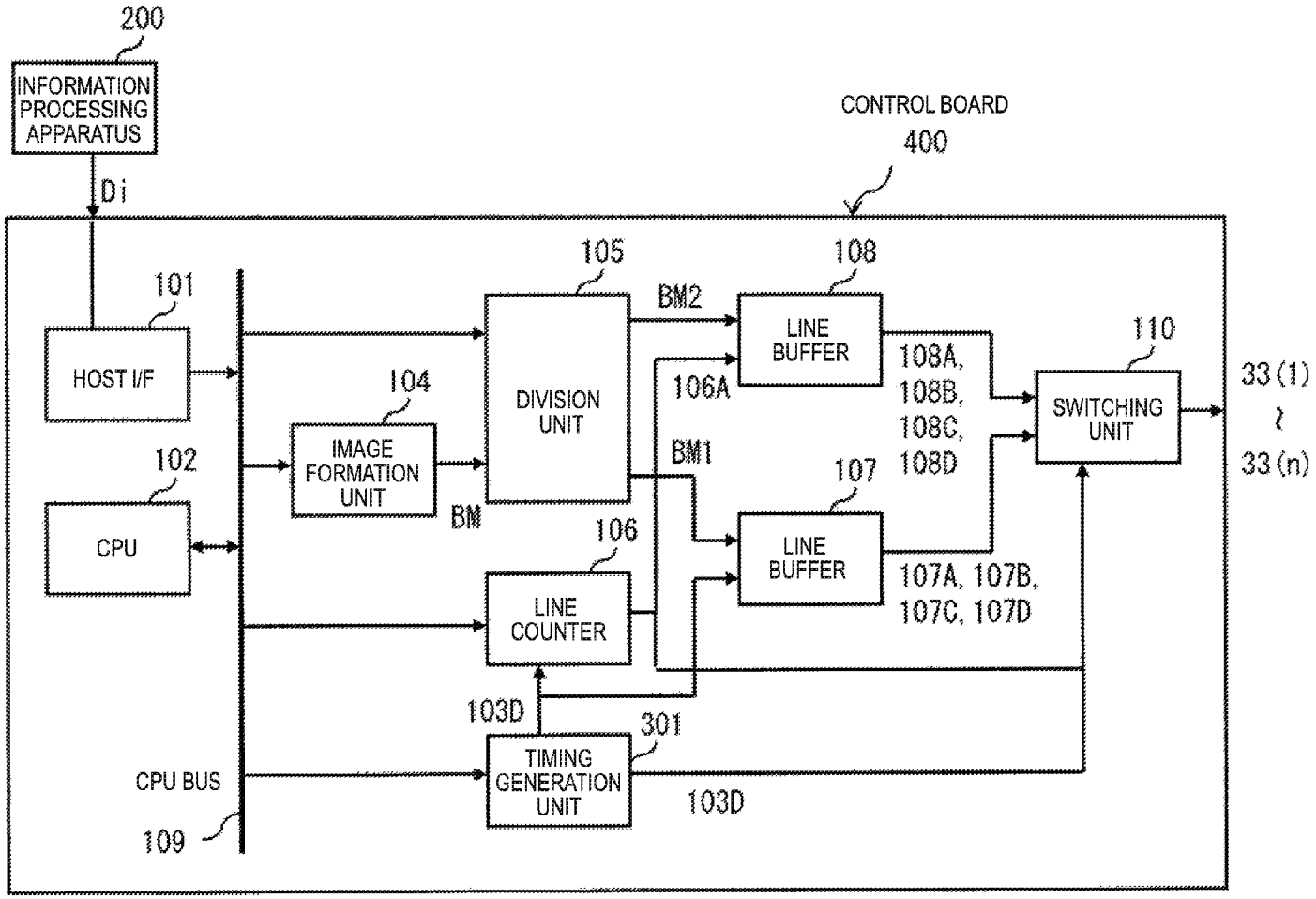
FIG. 18 is a diagram illustrating a function block example of a control board in the light-emitting apparatus in FIG. 17.

As illustrated in FIG. 18, control substrate 400 corresponds to a control board 300 in the abovementioned embodiment in which: acceleration sensor 302 is omitted; and switching unit 110 that connects outputs from line buffers 107 and 108 to one of multiple LED head modules 33 is provided, for example. Switching unit 110 sequentially selects multiple LED head modules 33 one by one based on line synchronization signals 103D and 106A from timing generation unit 301 and line counter 106.

For example, when a person intends to cross the front of light-emitting apparatus 4, multiple LED head modules 33 successively output light of multiple segments (video image for one line) in which a video image is divided. This causes the person to recognize past light having been outputted from light-emitting apparatus 4 as an afterimage, and accordingly to recognize a video image being projected from the entire display unit 4A of light-emitting apparatus 4.

Similar to image formation apparatus 1 in the above-mentioned embodiment, bit map data BM or line data BMLD is divided into line data BMLD1 and line data BMLD2 based on a pixel pattern of bit map data BM or line data BMLD with light-emitting apparatus 4 in this embodiment. This allows bit map data BM or line data BMLD to be divided into two line data BMLD1 and BMLD2 at an outline (outer periphery) portion of a pixel pattern where a streak is inconspicuous. As a result, it is possible to make the streak be inconspicuous in the video image.

<5. Modification Examples>

Hereinafter, various modification examples are described.

In the above-mentioned first and second embodiments, although an image is transferred by a direct method, an image may be transferred by an indirect method. Moreover, LED 137 is used in the above-mentioned respective embodiments; however, a laser element or other elements may be used instead of LED 137 or with LED 137 in the above-mentioned respective embodiments.

A series of processes described in the above-mentioned respective embodiments may be implemented by either hardware (circuit) or software (program). When the above-mentioned series of processes is implemented by software, the software is configured to include a group of programs to cause the respective functions to be executed by a computer. The respective programs may be, for example, incorporated in the above-mentioned computer in advance, or may be installed in the above-mentioned computer through a network or by a recording medium.

In the above-mentioned first and second embodiments, one embodiment of the invention is described using an electrophotographic printer as an example. However, the invention is not limited to the application to a color device or a printer, but can be applied to a typical image formation apparatus that forms an image on a conveyed medium. The invention can be applied to, for example, monochrome copiers, color copiers, monochrome MFPs, color MFPs, and the like.

Further, the invention can reduce problems (generation of a streak) that occur in: the field where a light-emitting module that is a combination of array-shaped heads in which multiple linear light sources and multiple light-emitting elements are arranged multi-dimensionally, such as one-dimensionally or two-dimensionally; and an image projection system and other systems in which images of multiple projectors are projected by being partially overlapped, for example.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A light-emitting apparatus comprising:

a first array-shaped light emitter in which first light-emitting elements are placed in an array;

a second array-shaped light emitter in which second light-emitting elements are placed in an array, such that the first and second array-shaped light emitters are arranged in substantially parallel with each other to have an overlapping portion where a part of an area where the first array-shaped light emitter is capable of forming an image and a part of an area where the second array-shaped light emitter is capable of forming an image are overlapped with each other, wherein the first and second array-shaped light emitters collectively form a line image based on a pixel pattern of bit map data including multiple pixel data;

a division unit that:

extracts, from an overlapping portion of the bit map data that corresponds to the overlapping portion between the first and second array-shaped light emitters, a boundary position where adjacent pixel data in the overlapping portion of the bit map data are different from each other; and divides, based on the extracted boundary position, the bit map data into a first partial bit map data for the first array-shaped light emitter and a second partial bit map data for the first array-shaped light emitter; and a controller that allocates the first and second partial bit map data to the first and second array-shaped light emitters, respectively, and controls the first and second array-shaped light emitters based on the first and second partial bit map data.

2. The light-emitting apparatus according to claim 1, wherein the division unit sets the extracted boundary position in the overlapping portion of the bit map data, as a divided position of the bit map data into the first and second partial bit map data.

3. The light-emitting apparatus according to claim 1, wherein in a condition in which it is determined, based on the extracted boundary position, that there is no boundary position in the overlapping portion of the bit map data such that all the pixel data in the overlapping portion of the bit map date are non-light-emitting data, the division unit sets an arbitrary position in pixel data in the overlapping portion of the bit map data as a divided position of the bit map data into the first and second partial bit map data.

4. The light-emitting apparatus according to claim 1, wherein in a condition in which it is determined, based on the extracted boundary position, that there is no boundary position in the overlapping portion of the bit map data such that all the pixel data in the overlapping portion of the bit map data are light-emitting data, the controller outputs a control signal that causes all portions in the overlapping portion of each of the first array-shaped light emitter and the second array-shaped light emitter to emit light.

5. The light-emitting apparatus according to claim 1, wherein in a condition in which it is determined, based on the extracted boundary position, that there is no boundary position in the overlapping portion of the bit map data such that all the pixel data in the overlapping portion of the bit map data are non-light-emitting data, the controller outputs a control signal that causes all portions in the overlapping portion of each of the first array-shaped light emitter and the second array-shaped light emitter not to emit light.

6. The light-emitting apparatus according to claim 1, wherein the division unit extracts line data for one line from the bit map data, and extracts, from the overlapping portion of the bit map data that corresponds to the overlapping portion between the first and second array-shaped light emitters, the boundary position where adjacent pixel data in the overlapping portion of the bit map data are different from each other for each of the extracted line data, to divide the line data into the first and second partial bit map data.

7. The light-emitting apparatus according to claim 6, wherein the division unit sets the boundary position where values of the adjacent pixel data in the overlapping portion out of the line data are different from each other, as a divided position of the line data.

8. The light-emitting apparatus according to claim 7, wherein in a condition in which it is determined, based on the result of the extracting step, that plural boundary positions are present in the pixel data in the overlapping portion out of the line data, the division unit sets one of the boundary positions where an adjacent one of the other boundary positions is farthest, as a divided position of the line data.

9. The light-emitting apparatus according to claim 8, wherein in a condition in which it is determined, based on the result of the extracting step, that plural boundary positions are present in the pixel data in the overlapping portion out of the line data, the division unit sets one of the boundary positions close to the divided position set in the last line data, as a divided position of the line data.

10. The light-emitting apparatus according to claim 7, wherein in a condition in which it is determined, based on the result of the extracting step, that plural boundary positions are present in the pixel data in the overlapping portion out of the line data, the division unit sets one of the boundary positions close to the divided position set in the last line data, as a divided position of the line data.

11. An image formation apparatus comprising:

an image carrier that includes a peripheral surface with a photoreceptor layer;

a light-emitting apparatus according to claim 1 as an exposure unit that is placed facing the peripheral surface, and exposes the peripheral surface to form a latent image; and a development member that is placed facing the peripheral surface, and develops the latent image with a developer.

* * * * *